US006431746B1

(12) United States Patent
Jujo et al.

(10) Patent No.: US 6,431,746 B1
(45) Date of Patent: Aug. 13, 2002

(54) MECHANICAL TIMEPIECE WITH TIMED ANNULAR BALANCE ROTATING ANGLE CONTROL MECHANISM

(75) Inventors: Koichiro Jujo; Takeshi Tokoro, both of Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/719,920

(22) PCT Filed: Jun. 29, 1999

(86) PCT No.: PCT/JP99/03487

§ 371 (c)(1),
(2), (4) Date: Feb. 20, 2001

(87) PCT Pub. No.: WO00/67077

PCT Pub. Date: Nov. 9, 2000

(30) Foreign Application Priority Data

Apr. 28, 1999 (JP) ..... PCT/JP99/2282

(51) Int. Cl.[7] ..... G04B 15/00; G04B 17/20; G04B 17/04

(52) U.S. Cl. ..... 368/127; 368/170; 368/175

(58) Field of Search ..... 368/124, 125, 368/126, 127–131, 139, 140, 168–171, 175–178

(56) References Cited

U.S. PATENT DOCUMENTS 3,845,616 A * 11/1974 Jeanmairet et al.

3,949,547 A * 4/1976 Schneiter

FOREIGN PATENT DOCUMENTS

| | | |
|---|---|---|
| CH | 0027544 | 1/1904 |
| FR | 2158373 | 6/1973 |
| GB | 1358657 | 7/1974 |
| JP | 48-43369 | * 6/1973 |
| JP | 48-85278 | * 11/1973 |

* cited by examiner

*Primary Examiner*—Vit Miska
(74) *Attorney, Agent, or Firm*—Adams & Wilks

(57) ABSTRACT

A mechanical timepiece has a power source comprised of a mainspring for undergoing rewinding movement to generate a rotational force. A front train wheel undergoes rotation in accordance with a rotational force generated during rewinding movement of the mainspring. An escapement/speed-control device controls rotation of the front train wheel. The escapement/speed-control device has a balance with a hairspring for undergoing alternately repeating rotational movement in left and right directions. An escape wheel and pinion undergoes rotation in accordance with rotation of the front train wheel. A pallet fork controls rotation of the escape wheel and pinion in accordance with rotational movement of the balance. A switch mechanism outputs an ON signal when a rotation angle of the balance reaches a predetermined threshold angle or greater, outputs an OFF signal when the rotation angle of the balance does not exceed the predetermined threshold angle. A rotation angle control mechanism supresses rotation of the balance when the switch mechanism outputs an ON signal.

9 Claims, 20 Drawing Sheets

TRANSITION OF INSTANTANEOUS
WATCH ERROR DUE TO SWING ANGLE

MECHANICAL TIMEPIECE WITH TIMED ANNULAR BALANCE ROTATING ANGLE CONTROL MECHANISM

BACKGROUND OF THE INVENTION

Field of the Invention

The present invention relates to a mechanical timepiece having a mechanical timepiece having a balance-with-hairspring rotation angle control mechanism structured to apply to the balance with hairspring such a force as suppressing against rotation of the balance with hairspring. Also, the invention relates to a mechanical timepiece having a switch adjuster mechanism used to adjust positions of a first contact member and second contact member relative to a near-outer-end portion of the stud-mainspring and a spacing between the first contact member and the second contact member. Furthermore, the invention relates to a mechanical-timepiece adjuster device for adjusting positions of first contact and second contact members relative to a near-outer-portion of the stud mainspring.

Background Information

In the conventional mechanical timepiece, as shown in FIG. 13 and FIG. 14 the mechanical-timepiece movement 1100 (mechanical body) has a main plate 1102 constituting a base plate for the movement. A hand setting stem 1110 is rotatably assembled in a hand-setting-stem guide hole 1102*a* of the main plate 1102. A dial 1104 (shown by the virtual line in FIG. 14) is attached to the movement 1100.

Generally, a main plate has two opposite sides, one side having a dial is referred to as a "back side" of the movement and the opposite side to the side having the dial is referred to as a "front side". The train wheel assembled on the "front side" of the movement is referred to as a "front train wheel" and the train wheel assembled on the "back side" of the movement is as a "back train wheel".

The hand setting stem 1110 is determined in axial position by a switch device including a setting lever 1190, a yoke 1192, a yoke spring 1194 and a back holder 1196. A winding pinion 1112 is rotatably provided on a guide axis portion of the hand setting stem 1110. When rotating the hand setting stem 1110 in a state the hand setting stem 1110 is in a first hand-setting-stem position closest to an inward of the movement along a rotation axis direction (0 the stage), the winding pinion 1112 rotates through rotation of the clutch wheel. A crown wheel 1114 rotates due to rotation of the winding pinion 1112. A ratchet wheel 1116 rotates due to rotation of the crown wheel 1114. By rotating the ratchet wheel 1116, a mainspring 1122 accommodated in a barrel complete 1120 is wound up. A center wheel and pinion 1124 rotates due to rotation of the barrel complete 1120. An escape wheel and pinion 1130 rotates through rotation of a fourth wheel and pinion 1128, third wheel and pinion 1126 and center wheel and pinion 1124. The barrel complete 1120, center wheel and pinion 1124, third wheel and pinion 1126 and fourth wheel and pinion 1128 constitutes a front train wheel.

An escapement/speed-control device for controlling rotation of the front train wheel includes a balance with hairspring 1140, an escape wheel and pinion 1130 and pallet fork 1142. The balance with hairspring 1140 includes a balance stem 1140*a*, a balance wheel 1140*b* and a stud mainspring 1140*c*. Based on the center wheel and pinion 1124, an hour pinion 1150 rotates simultaneously. A minute hand 1152 attached on the hour wheel 1150 indicates "minute". The hour pinion 1150 is provided with a slip mechanism for the center wheel and pinion 1124. Based on rotation of the hour pinion 1150, an hour wheel 1154 rotates through rotation of a minute wheel. An hour hand 1156 attached on the hour wheel 1154 indicates "hour".

The barrel complete 1120 is rotatably supported relative to the main plate 1102 and barrel bridge 1160. The center wheel and pinion 1124, the third wheel and pinion 1126, the fourth wheel and pinion 1128 and the escape wheel and pinion 1130 are rotatably supported relative to the main plate 1102 and train wheel bridge 1162. The pallet fork 1142 is rotatably supported relative to the main plate 1102 and pallet fork bridge 1164. The balance with hair spring 1140 is rotatably supported relative to the main plate 1102 and balance bridge 1166.

The stud mainspring 1140*c* is a thin leaf spring in a spiral (helical)form having a plurality of turns. The stud mainspring 1140*c* at an inner end is fixed to a stud ball 1140*d* fixed on the balance stem 1140*a*, and the stud mainspring 1140*c* at an outer end is fixed by screwing through a stud support 1170*a* attached to a stud bridge 1170 fixed on the balance bridge 1166.

A regulator 1168 is rotatably attached on the balance bridge 1166. A stud bridge 1168*a* and a stud rod 1168*b* are attached on the regulator 1168. The stud mainspring 1140*c* has a near-outer-end portion positioned between the stud bridge 1168*a* and the stud rod 1168*b*.

Generally, in the conventional representative mechanical timepiece, as shown in FIG. 8 the torque on the mainspring torque also decreases while being rewound as the sustaining time elapses from a state the mainspring is fully wound (full winding state). For example, in the case of FIG. 8, the mainspring torque in the full winding state is about 27 g·cm, which becomes about 23 g·cm at a lapse of 20 hours from the full winding state and about 18 g·cm at a lapse of 40 hours from the full winding state.

Generally, in the conventional representative mechanical timepiece, as shown in FIG. 9 the decrease of mainspring torque also decreases a swing angle of the balance with hairspring. For example, in the case of FIG. 9, the swing angle of the balance with hairspring is approximately 240 degrees to 270 degrees when the mainspring torque is 25 g·cm to 28 g·cm while the swing angle of the balance with hairspring is approximately 180 degrees to 240 degrees when the mainspring torque is 20 g·cm to 25 g·cm.

Referring to FIG. 10, there is shown transition of an instantaneous watch error (numeral value indicative of timepiece accuracy) against a swing angle of a balance with hairspring in the conventional representative mechanical timepiece. Here, "instantaneous watch error" refers to "a value representative of fast or slow of a mechanical timepiece at a lapse of one day on the assumption that the mechanical timepiece is allowed to stand while maintaining a state or environment of a swing angle of a balance with hairspring upon measuring a watch error". In the case of FIG. 10, the instantaneous watch error delays when the swing angle of the balance with hairspring is 240 degrees or greater or 200 degrees or smaller.

For example, in the conventional representative mechanical timepiece, as shown in FIG. 10 the instantaneous watch error is about 0 degree to 5 seconds per day (about 0 degree to 5 seconds fast per day) when the swing angle of the balance with hairspring is about 200 degrees to 240 degrees while the instantaneous watch error becomes about −20 seconds per day (about 20 seconds slow per day) when the swing angle of the balance with hairspring is about 170 degrees.

Referring to FIG. 12, there is shown a transition of an instantaneous watch error and a lapse time upon rewinding the mainspring from a full winding state in the conventional representative mechanical timepiece. Here, in the conventional mechanical timepiece, the "watch error" indicative of timepiece advancement per day or timepiece delay per day is shown by an extremely thin line in FIG. 12, which is obtainable by integrating over 24 hours an instantaneous watch error against a lapse time of rewinding the mainspring from the full winding.

Generally, in the conventional mechanical timepiece, the instantaneous watch error slows down because the mainspring torque decreases and the balance-with-hairspring swing angle decreases as the sustaining time elapses with the mainspring being rewound from a full winding state. Due to this, in the conventional mechanical timepiece, the instantaneous watch error in a mainspring full winding state is previously put forward in expectation of timepiece delay after lapse of a sustaining time of 24 hours, thereby previously adjusting plus the "watch error" representative of timepiece advancement or delay per day.

For example, in the conventional representative mechanical timepiece, as shown by an extreme thin line in FIG. 12 the instantaneous watch error in a full winding state is about 3 seconds per day (3 seconds fast per day). However, when 20 hour elapses from the full winding state, the instantaneous watch error becomes about −3 seconds per day (about 3 seconds slow per day). When 24 hours elapses from the full winding state, the instantaneous watch error becomes about −8 seconds per day (about 8 seconds slow per day). When 30 hours elapses from the full winding state, the instantaneous watch error becomes about −16 seconds per day (about 16 seconds slow per day).

Incidentally, as a conventional balance-with-hairspring swing angle adjusting device there is a disclosure, for example, in Japanese Utility model Laid-open No. 41675/1979 of one having a swing angle adjusting plate to generate over-current each time a magnet of the balance with hairspring approaches by swinging and give brake force to the balance with hairspring.

It is an object of the invention to provide a mechanical timepiece having a balance-with-hairspring rotation angle control mechanism that can control the swing angle of the balance with hairspring to be fallen within a constant range.

Furthermore, an object of the invention is to provide a mechanical timepiece which is less changed in watch error and accurate even after lapse of time from the full winding state.

Furthermore, an object of the invention is to provide a mechanical timepiece having a switch adjuster device used to adjust positions of first contact and second contact members relative to a near-outer-end portion of the stud mainspring and a spacing between the first contact and second contact members.

Furthermore, an object of the invention is to provide a mechanical-timepiece adjuster device for adjusting positions of first contact and second contact members relative to a near-outer-end portion of the stud mainspring.

SUMMARY OF THE INVENTION

The present invention is, in a mechanical timepiece structured having a mainspring constituting a power source for the mechanical timepiece, a front train wheel rotating due to rotational force given upon rewinding the mainspring and an escapement/speed-control device for controlling rotation of the front train wheel, the escapement/speed-control device being structured including a balance with hairspring alternately repeating right and left rotation, an escape wheel and pinion rotating based on rotation of the front train wheel and a pallet fork controlling rotation of the escape wheel and pinion based on operation of the balance with hairspring, characterized by comprising: a switch mechanism structured to output an on signal when a rotation angle of the balance with hairspring becomes a predetermined threshold or greater, and an off signal when the rotation angle of the balance with hairspring is not excess of the predetermined threshold; and a balance-with-hairspring rotation angle control mechanism structured to apply such a force as suppressing against rotation of the balance with hairspring when the switch mechanism outputs an on signal.

In the mechanical timepiece of the invention, the switch mechanism is preferably structured to output an on signal when a stud mainspring provided on the balance with hairspring contacts a contact member constituting a switch lever.

Also, in the mechanical timepiece of the invention, the balance-with-hairspring rotation angle control mechanism preferably includes a balance magnet provided on the balance with hairspring and a coil arranged to exert a magnetic force to the balance magnet, and the coil being structured to apply a magnetic force to the balance magnet to suppress rotation of the balance with hairspring when the switch mechanism outputs an on signal, and not to apply a magnetic force to the balance magnet when the switch mechanism outputs an off signal.

By using a balance-with-hairspring rotation angle control mechanism thus structured, it is possible to effectively control the rotation angle of the balance with hairspring of the mechanical timepiece thereby improving accuracy for the mechanical timepiece.

Also, in the mechanical timepiece of the invention, the switch mechanism preferably includes a first contact member and a second contact member, and further comprising an adjuster device for changing a spacing between the first contact member and the second contact member.

Also, in the mechanical timepiece of the invention, the switch mechanism preferably includes a first contact member and a second contact member, and further comprising an adjuster device for simultaneously move the first contact member and the second contact member relative to a rotation center of the balance with hairspring.

Also, in the mechanical timepiece of the invention, the adjuster device preferably includes a switch body-provided rotatable about a rotation center of the balance with hairspring, a switch insulating member arranged slidable relative to the switch body, and a switch spacing adjusting lever having a first contact and a second contact.

Also, in the mechanical timepiece of the invention, the adjuster device preferably includes a switch body provided rotatable about a rotation center of the balance with hairspring, a switch insulating member arranged slidable relative to the switch body, and a switch position adjusting lever having an eccentric portion provided rotatable relative to the switch body and to be fit in an elongate hole of the switch insulating member.

BRIEF DESCRIPTION OF THE DRAWINGS

FIG. 5 is a magnified fragmentary sectional view showing a schematic form of a balance with hairspring part of the mechanical timepiece of the invention in a state the switch mechanism is on.

FIG. 6 is a magnified fragmentary sectional view showing a schematic form of a balance with hairspring part of the mechanical timepiece of the invention in a state the switch mechanism is on.

DETAILED DESCRIPTION OF THE EMBODIMENTS

Hereunder, embodiments of a mechanical timepiece of the present invention will be explained based on the drawings.

Figure 1:
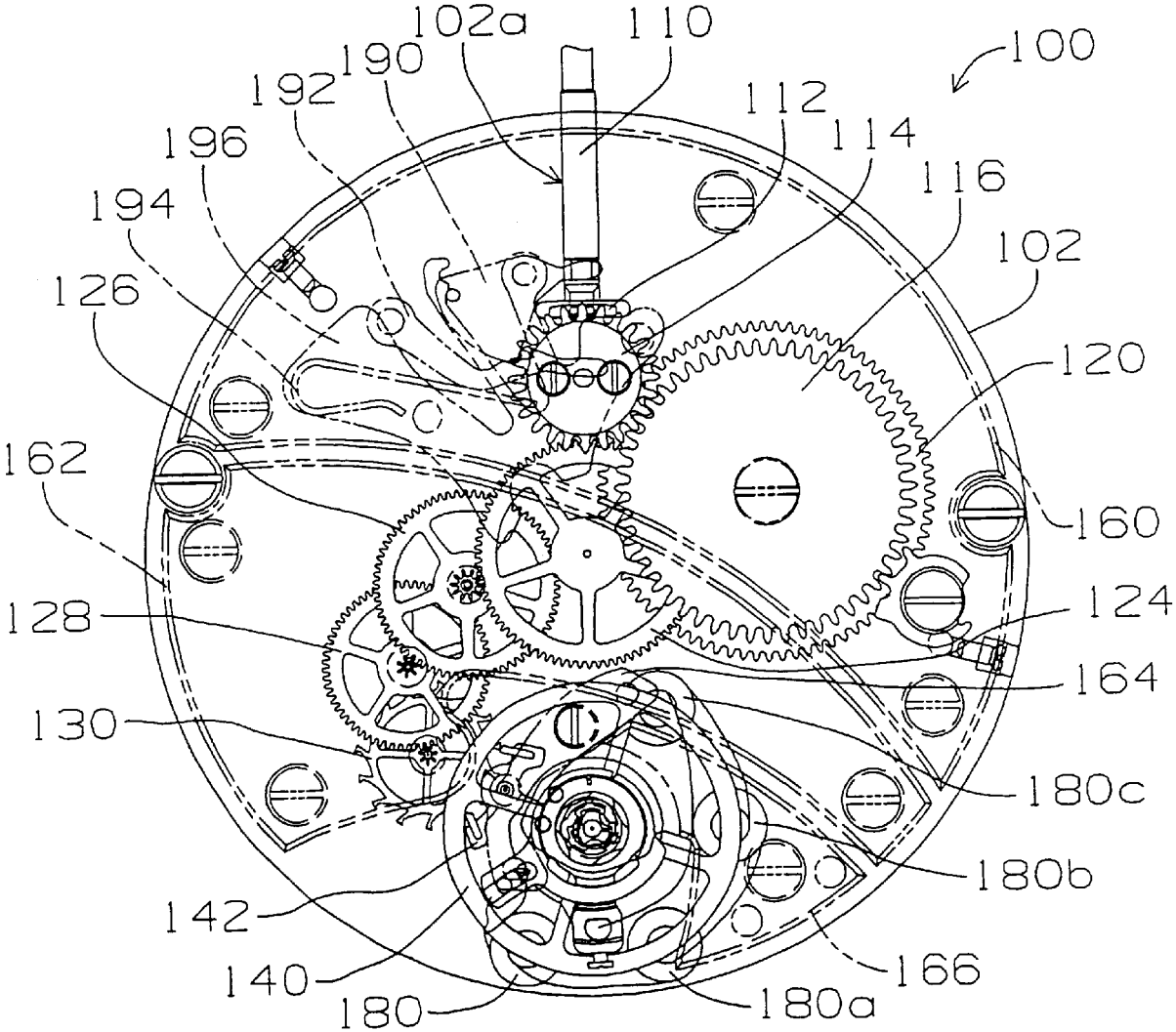
FIG. 1 is a plan view showing a schematic form of a movement front side of a mechanical timepiece of the present invention (in FIG. 1, parts are partly omitted and bridge members are shown by virtual lines).
Figure 2:
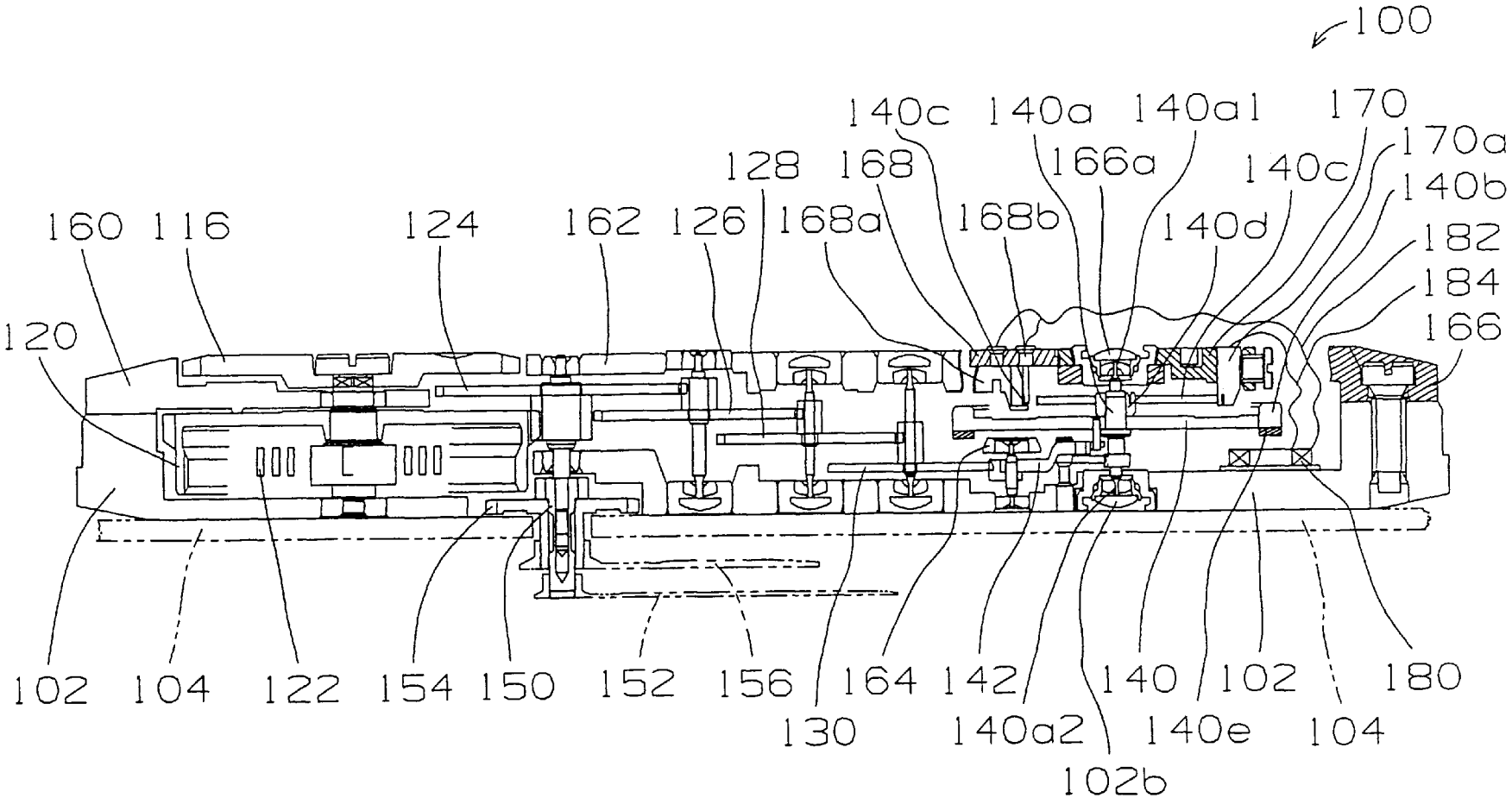
FIG. 2 is a schematic fragmentary sectional view showing the movement of the invention (in FIG. 2, parts are partly omitted).

Referring to FIG. 1 and FIG. 2, in an embodiment of a mechanical timepiece of the invention, a movement (mechanical body) 100 of the mechanical timepiece has a main plate 102 structuring a base plate for the movement. A hand setting stem 110 is rotatably assembled in a winding-stem guide hole 102*a* of the main plate 102. A dial 104 (shown by a virtual line in FIG. 2) is attached on the movement 100.

The hand setting stem 110 has a squared portion and a guide shaft portion. A clutch wheel (not shown) is assembled on the square portion of the hand setting stem 110. The clutch wheel has a same rotation axis as a rotation axis of the hand setting stem 110. That is, the clutch wheel is provided having a squared hole and rotated based on rotation of the hand setting stem 110 by fitting the squared hole on the squared portion of the hand setting stem 110. The clutch wheel has teeth A and teeth B. The teeth A are provided in the clutch wheel at an end close to a center of the movement. The teeth B are provided in the clutch wheel at an end close to an outside of the movement.

The movement 100 is provided with a switch device to determine an axial position of the winding stem 110. The switch device includes a setting lever 190, a yoke 192, a yoke spring 194 and a setting lever jumper 196. The hand-setting stem 110 is determined in rotation-axis position based on rotation of the setting lever. The clutch wheel is determined in rotation-axis position based on rotation of the yoke. The yoke is to be determined at two positions in rotational direction.

A winding pinion 112 is rotatably provided on the guide shaft portion of the hand setting stem 110. When the hand setting stem 110 is rotated in a state that the hand setting stem 110 is positioned at a first hand setting stem position closest to a movement inner side along the rotation axis direction (in a 0th stage), the winding pinion 112 is structurally rotated through rotation of the clutch wheel. A crown wheel 114 is structured to rotate due to rotation of the winding pinion 112. A ratchet wheel 116 is structured to rotate due to rotation of the crown wheel 114.

The movement 100 has as a power source a mainspring 122 accommodated in a barrel complete 120. The mainspring 122 is made of an elastic material having springiness, such as iron. The mainspring 122 is structured for rotation due to rotation of the ratchet wheel 116.

A center wheel and pinion 124 is structured for rotation due to rotation of the barrel complete 120. A third wheel and pinion 126 is structured rotatable based on rotation of the center wheel and pinion 124. A fourth wheel and pinion 128 is structured rotatable based on rotation of the third wheel and pinion 126. An escape wheel and pinion 130 is structured for rotation due to rotation of the fourth wheel and pinion 128. The barrel complete 120, the center wheel and pinion 124, the third wheel and pinion 126 and the fourth wheel and pinion 128 constitute a front train wheel.

The movement 100 has an escapement/governing device to control rotation of the front train wheel. The escapement/governing device includes a balance with hairspring 140 to repeat right and left rotation with a constant period, an escape wheel and pinion 130 to rotate based on rotation of the front train wheel, and pallet fork 142 to control rotation of the escape wheel and pinion 130 based on the operation of operation of the balance with hairspring 140.

The balance with hairspring 140 includes a balance stem 140*a*, a balance wheel 140*b* and a stud mainspring 140*c*. The stud mainspring 140*c* is made of an elastic material having springiness, such as "elinvar". That is, the stud mainspring 140*c* is made of a metallic conductive material.

Based on rotation of the center wheel and pinion 124, an hour pinion 150 simultaneously rotates. The hour pinion 150 is structured having a minute hand 152 to indicate "minute". The hour pinion 150 is provided with a slip mechanism having predetermined slip torque to the center wheel and pinion 124.

Based on rotation of the hour pinion 150, a minute wheel (not shown) rotates. Based on rotation of the minute wheel, an hour wheel 154 rotates. The hour wheel 154 is structured having an hour hand 156 to indicate "hour".

The barrel complete 120 is supported for rotation relative to the main plate 102 and barrel bridge 160. The center wheel and pinion 124, third wheel and pinion 126, fourth wheel and pinion 128 and escape wheel and pinion 130 are supported for rotation relative to the main plate 102 and train wheel bridge 162. The pallet fork 142 is supported for rotation relative to the main plate 102 and pallet bridge 164.

The balance with hairspring 140 is supported for rotation relative to the main plate 102 and balance bridge 166. That is, the balance stem 140*a* has an upper tenon 140*a*1 supported for rotation relative to a balance upper bearing 166*a* fixed on the balance bridge 166. The balance upper bearing 166*a* includes a balance upper hole jewel and a balance upper bridge jewel. The balance upper hole jewel and the balance upper balance jewel are formed of an insulating material such as ruby.

The balance stem 140*a* has a lower tenon 140*a*2 supported for rotation relative to the balance lower bearing 102*b* fixed on the main plate 102. The balance lower bearing 102*b* includes a balance lower hole jewel and a balance lower-bridge jewel. The balance lower hole jewel and the balance lower bridge jewel are made of an insulating material such as ruby.

The stud mainspring 140*c* is a thin leaf spring in a spiral (helical) form having a plurality of turns. The stud mainspring 140*c* at an inner end is fixed to a stud ball 140*d* fixed on the balance stem 140*a*, and the stud mainspring 140*c* at an outer end is screwed through a stud support 170*a*attached to a stud bridge 170 rotatably fixed on the balance bridge 166. The balance bridge 166 is made of a metallic conductive material such as brass. The stud bridge 170 is made of a metallic conductive material such as iron.

Next, explanation will be made on a switch mechanism of the mechanical timepiece of the invention.

Referring to FIG. 1 and FIG. 2, a switch lever 168 is rotatably attached on the balance bridge 166. A first contact member 168*a* and a second contact member 168*b* are attached on a switch lever 168. The switch lever 168 is attached on the balance bridge 166 for rotation about a rotation center of the balance with hairspring 140. The switch lever 168 is formed of a plastic insulating material such as polycarbonate. The first contact member 168*a* and the second contact member 168*b* are made of a metallic conductive material such as brass. The stud mainspring 140*c* at its near-outer-end portion is positioned between the first contact member 168*a* and the second contact member 168*b*.

Coils 180, 180*a*, 180*b*, 180*c* are attached on a front surface of the main plate 102 in a manner facing to a main-plate-side surface of the balance wheel 140*b*. The number of coils, as shown in FIG. 1 and FIG. 2, is for example four, but may be one, two, three or four or more.

A balance magnet 140e is attached on the main-plate-side surface of the balance wheel 140*b* in a manner facing to the front surface of the main plate 102.

Figure 3:
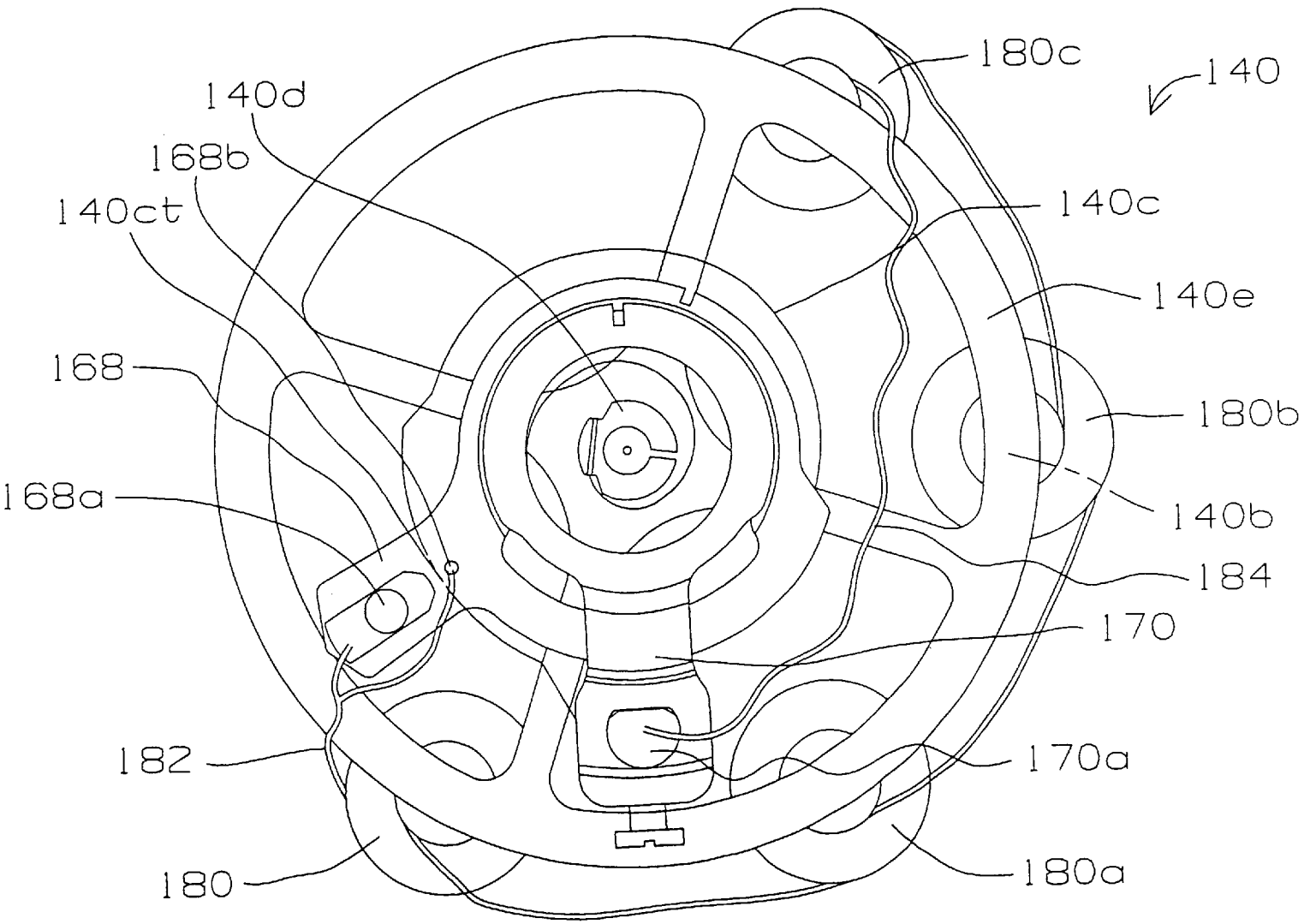
FIG. 3 is a magnified fragmentary sectional view showing a schematic form of a balance with hairspring part of the mechanical timepiece of the invention in a state a switch mechanism is off.
Figure 5:
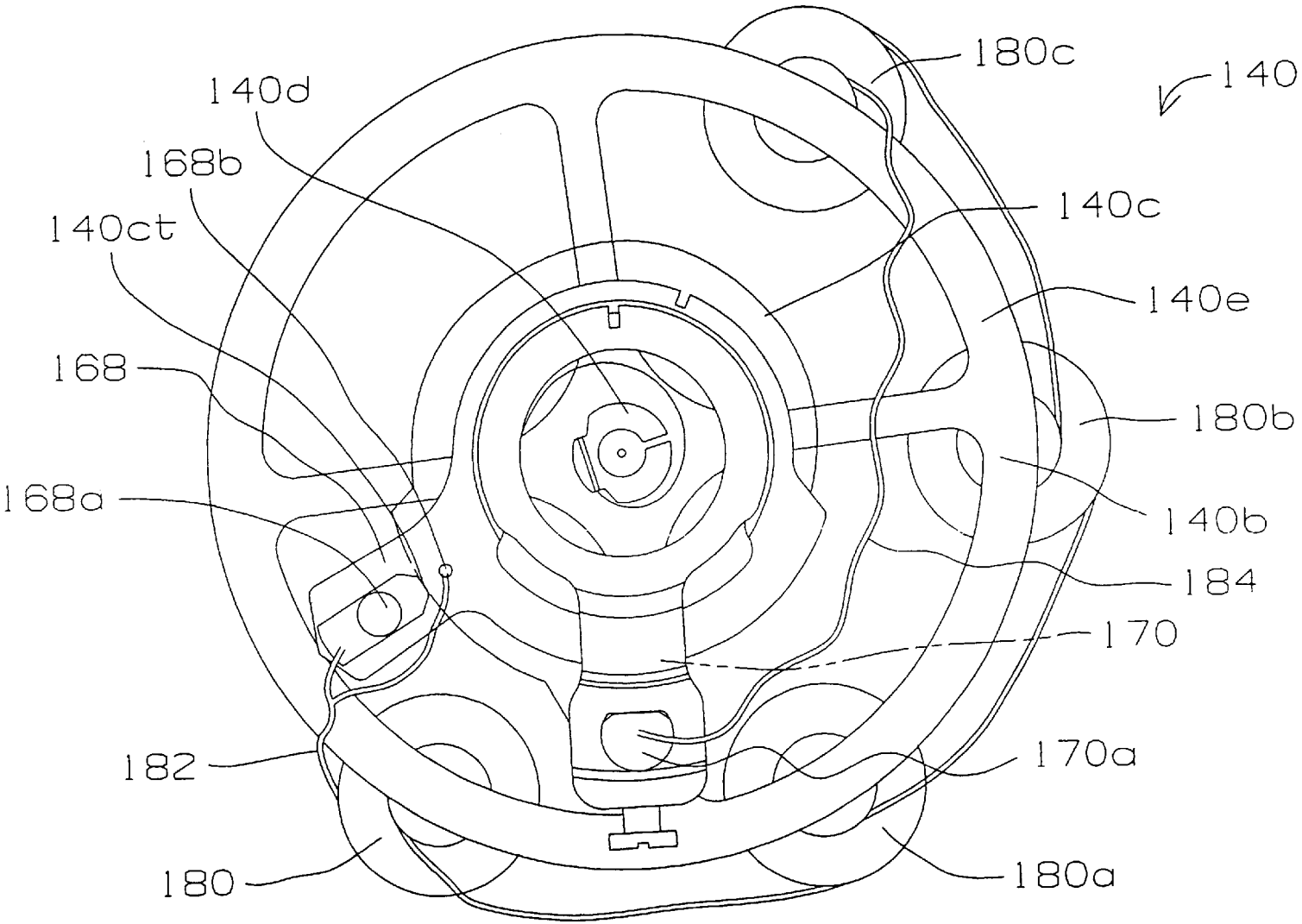

As shown in FIG. 1, FIG. 3 and FIG. 5, in the case of arranging a plurality of coils, a circumferential interval of the coils is preferably greater integer-times a circumferential interval between S and N poles of the balance magnet 140*e* arranged opposite to the coils. However, all the coils may not have a same interval in the circumferential direction. Furthermore, in such a structure as having a plurality of coils, the interconnections between the coils are preferably connected in series not to mutually cancel current generated on each coil due to electromagnetic induction. Otherwise, the interconnections between the coils may be connected in parallel not to mutually cancel current generated on each coil due to electromagnetic induction.

Figure 7:
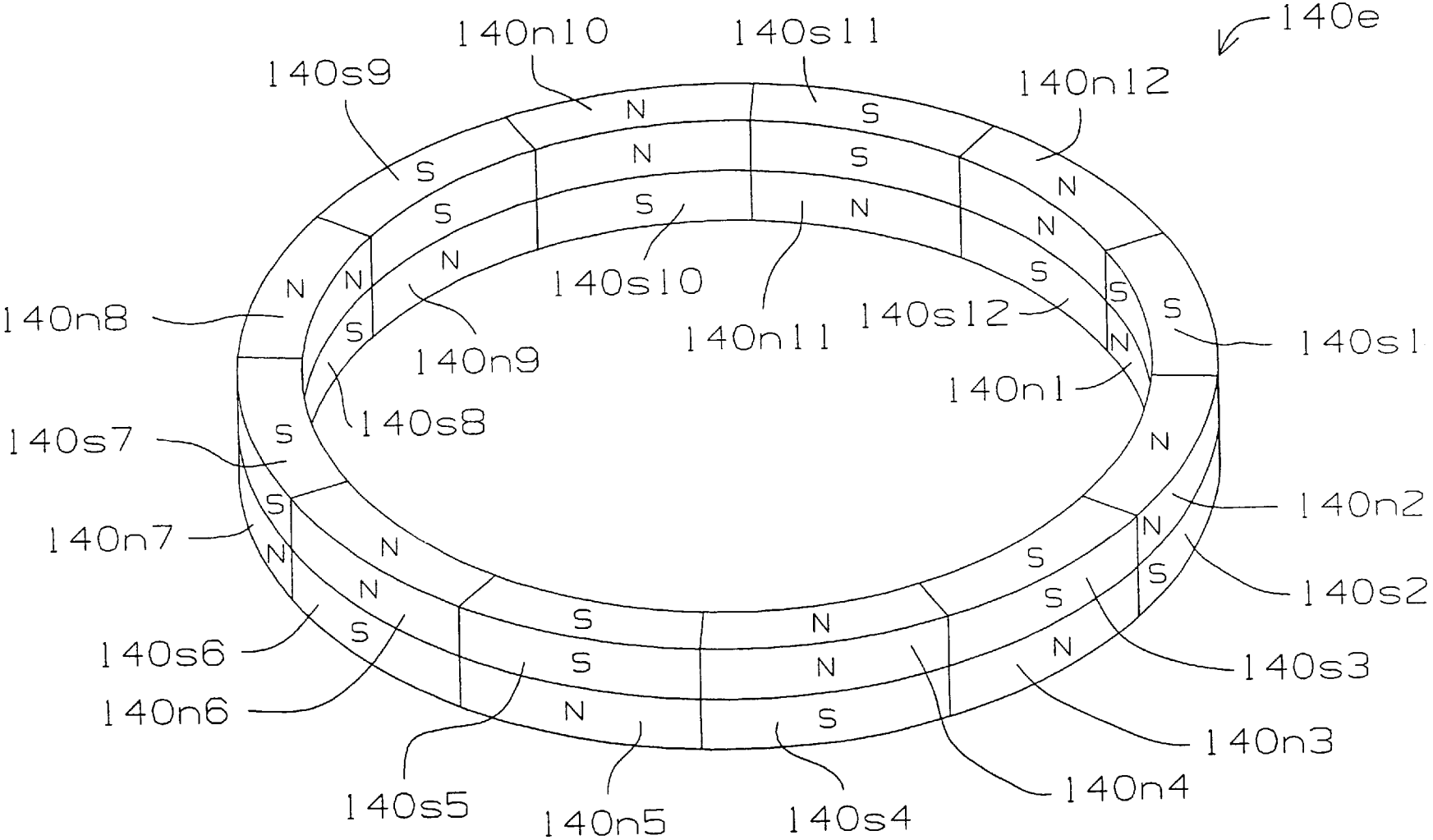
FIG. 7 is a perspective view showing a schematic form of a balance magnet used in the mechanical timepiece of the invention.
Figure 8:
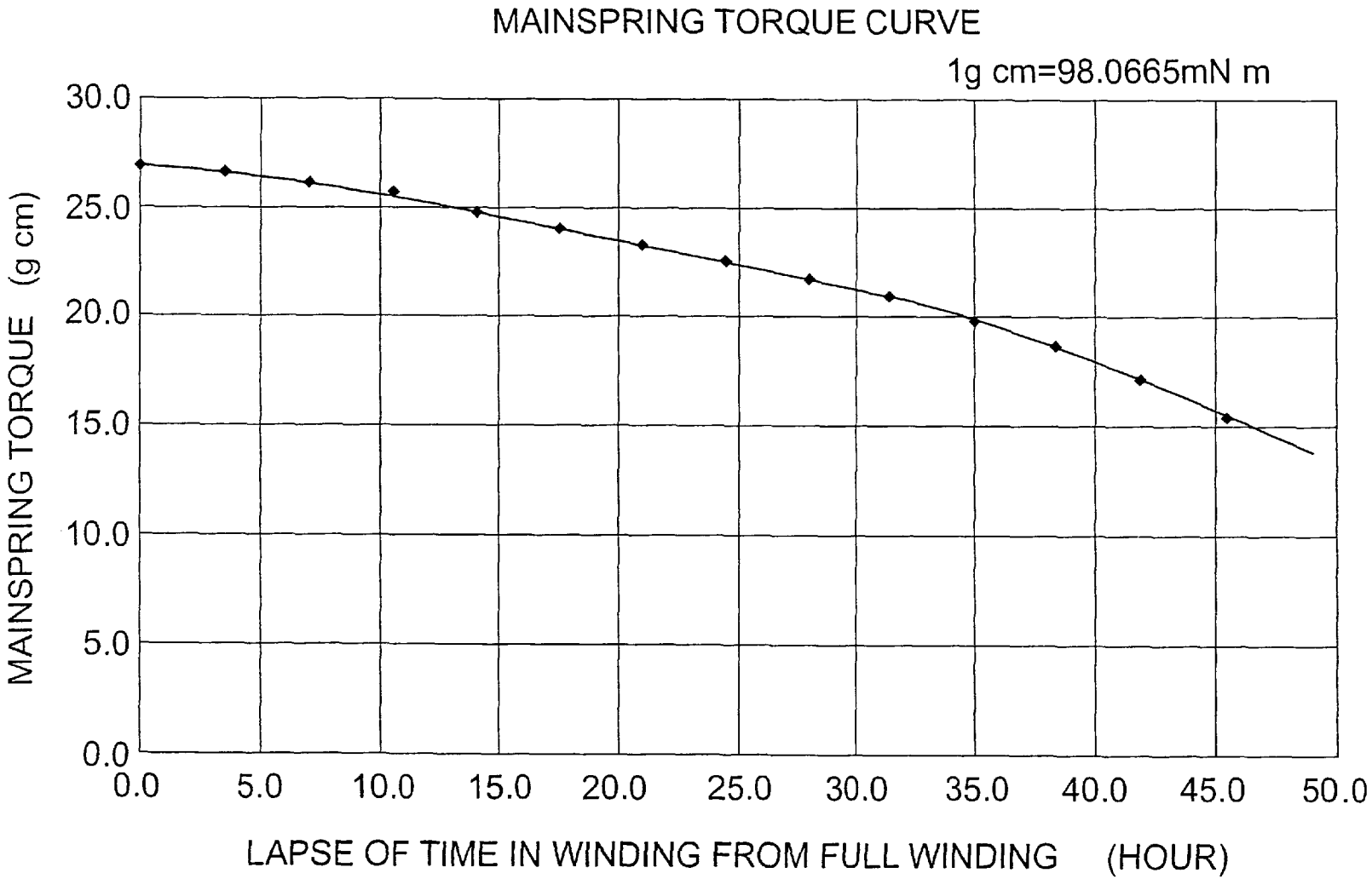
FIG. 8 is a graph schematically showing a relationship between a lapse of time in rewinding from a full winding state and a mainspring torque in the mechanical timepiece.
Figure 9:
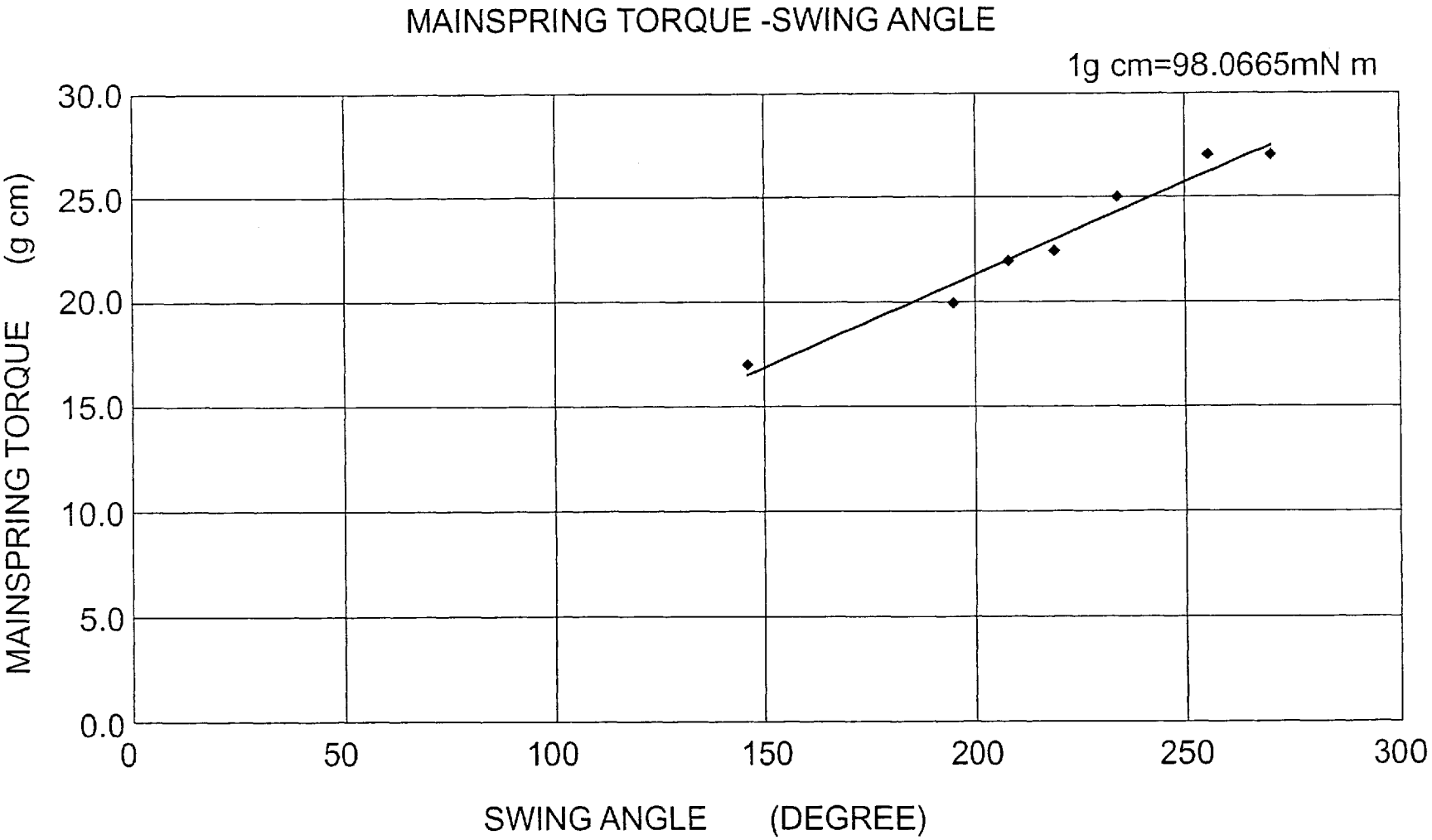
FIG. 9 is a graph schematically showing a relationship between a swing angle of a balance with hairspring and a mainspring torque in the mechanical timepiece.
Figure 10:
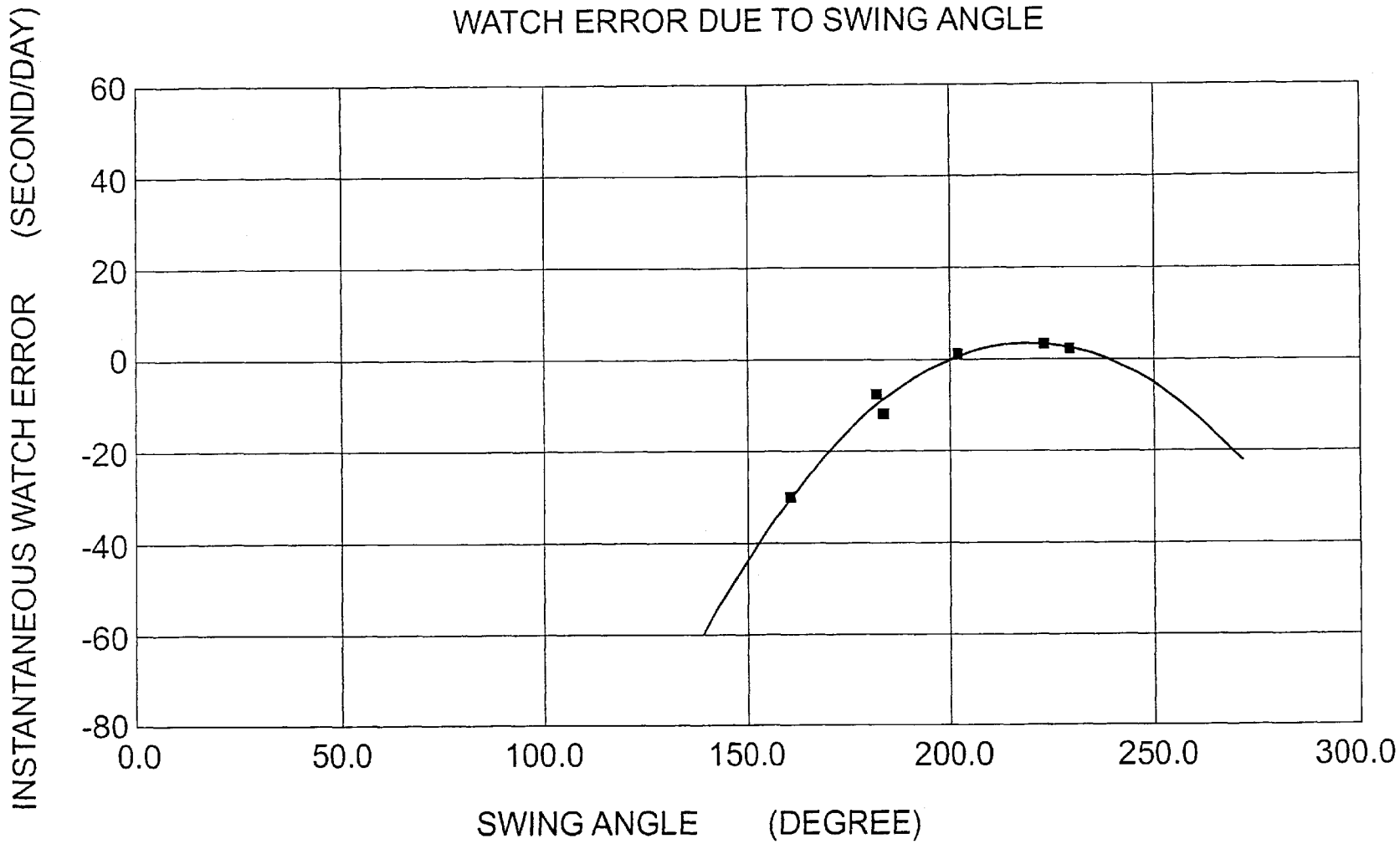
FIG. 10 is a graph schematically showing a relationship between a swing angle of a balance with hairspring and an instantaneous watch error in the mechanical timepiece.

Referring to FIG. 7, the balance magnet 140*e* has an annular (ring-formed) shape and is alternately provided, along a circumferential direction, with magnet portions constituted, for example, by twelve S poles 140*s*1–140*s*12 and twelve N poles 140*n*1–140*n*12 that are vertically polarized. Although the number of magnet portions arranged annular (in a ring form) in the balance magnet 140*e* in the example shown in FIG. 10 is twelve, it may be in a plurality of two or more. Here, it is preferred to provide the magnet portion with one bowstring length nearly equal to an outer diameter of one coil provided opposite to the magnet portion.

A gap is provided between the balance magnet 140*e* and the coil 180, 180*a*, 180*b*, 180*c*. The gap between the balance magnet 140*e* and the coil 180, 180*a*, 180*b*, 180*c* is determined such that the balance magnet 140*e* has a magnetic force capable of giving effects upon the coil 180, 180*a*, 180*b*, 180*c* when the coil 180, 180*a*, 180*b*, 180*c* is energized.

When the coil 180, 180*a*, 180*b*, 180*c* is not energized, the magnetic force on the balance magnet 140*e* will not have effects on the coil 180, 180*a*, 180*b*, 180*c*. The balance magnet 140*e* is fixed, for example, through adhesion to the main-plate-side surface of the balance wheel 140*b* in such a state that one surface is in contact with a ring rim of the balance wheel 140*b* and the other surface facing to the front surface of the main plate 102.

A first lead wire 182 is provided to connect between one terminal of the coil 180 and a first coil terminal 168*a* and second coil terminal 168*b*. A second lead wire 184 is provided to connect between one terminal of the coil 180*c* and the stud bridge 170.

Figure 4:
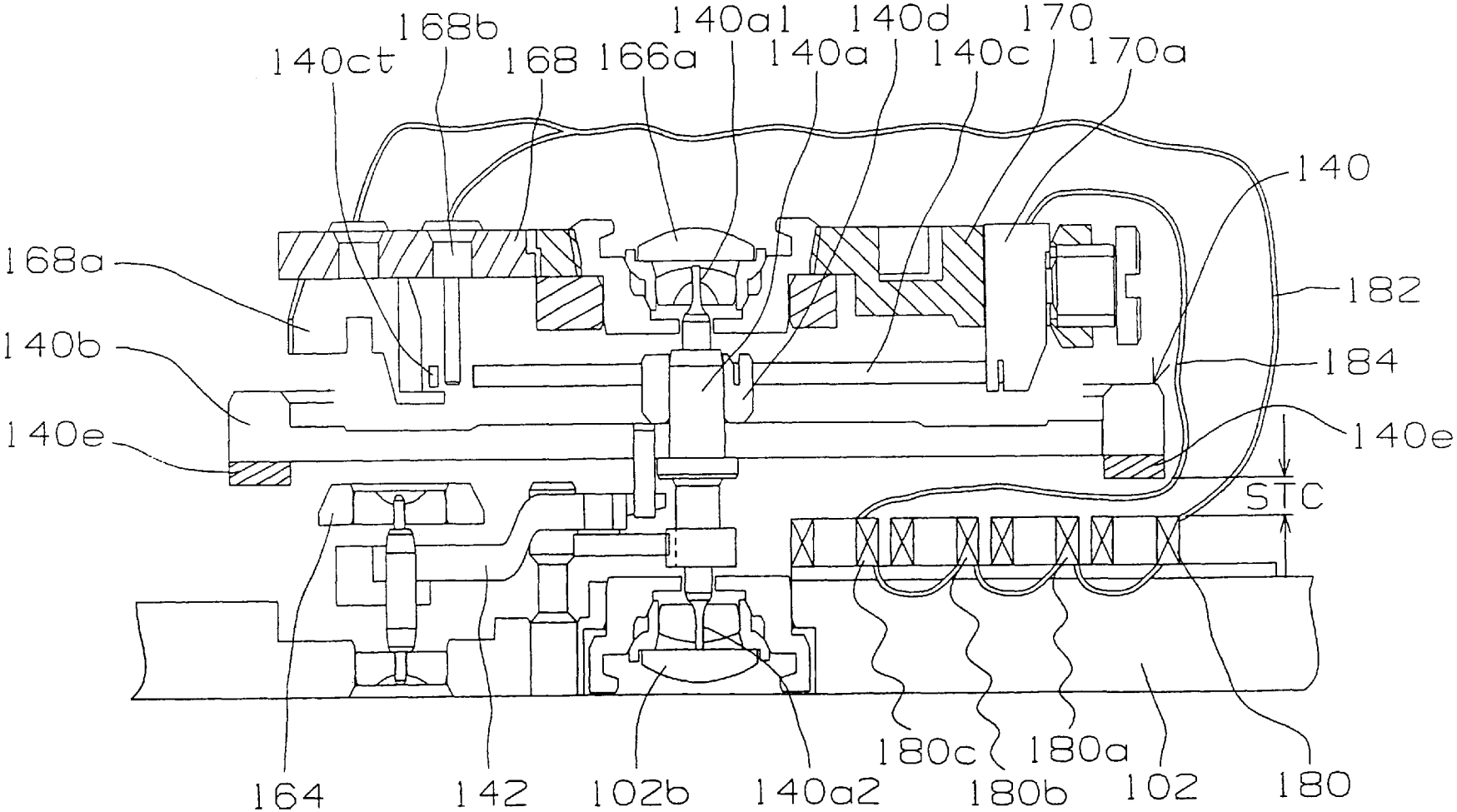
FIG. 4 is a magnified fragmentary sectional view showing a schematic form of a balance with hairspring part of the mechanical timepiece of the invention in a state a switch mechanism is off.

Incidentally, the stud mainspring 140*c* although illustrated by exaggeration in FIG. 4 has a thickness (radial thickness of the balance with hairspring) of 0.021 millimeter, forexample. The balance magnet 140*e* has, forexample,an outer diameter of approximately 9 millimeters, an inner diameter of approximately 7 millimeters, a thickness of approximately 1 millimeter and a magnetic flux density of approximately 0.02 tesla. The coil 180, 180*a*, 180*b*, 180*c* respectively has the number of turns, for example, of 8 turns and a coil diameter of approximately 25 micrometers. The gap STC between the balance magnet 140*e* and the coil 180, 180*a*, 180*b*, 180*c* is, for example, approximately 0.4 millimeter.

Figure 11:
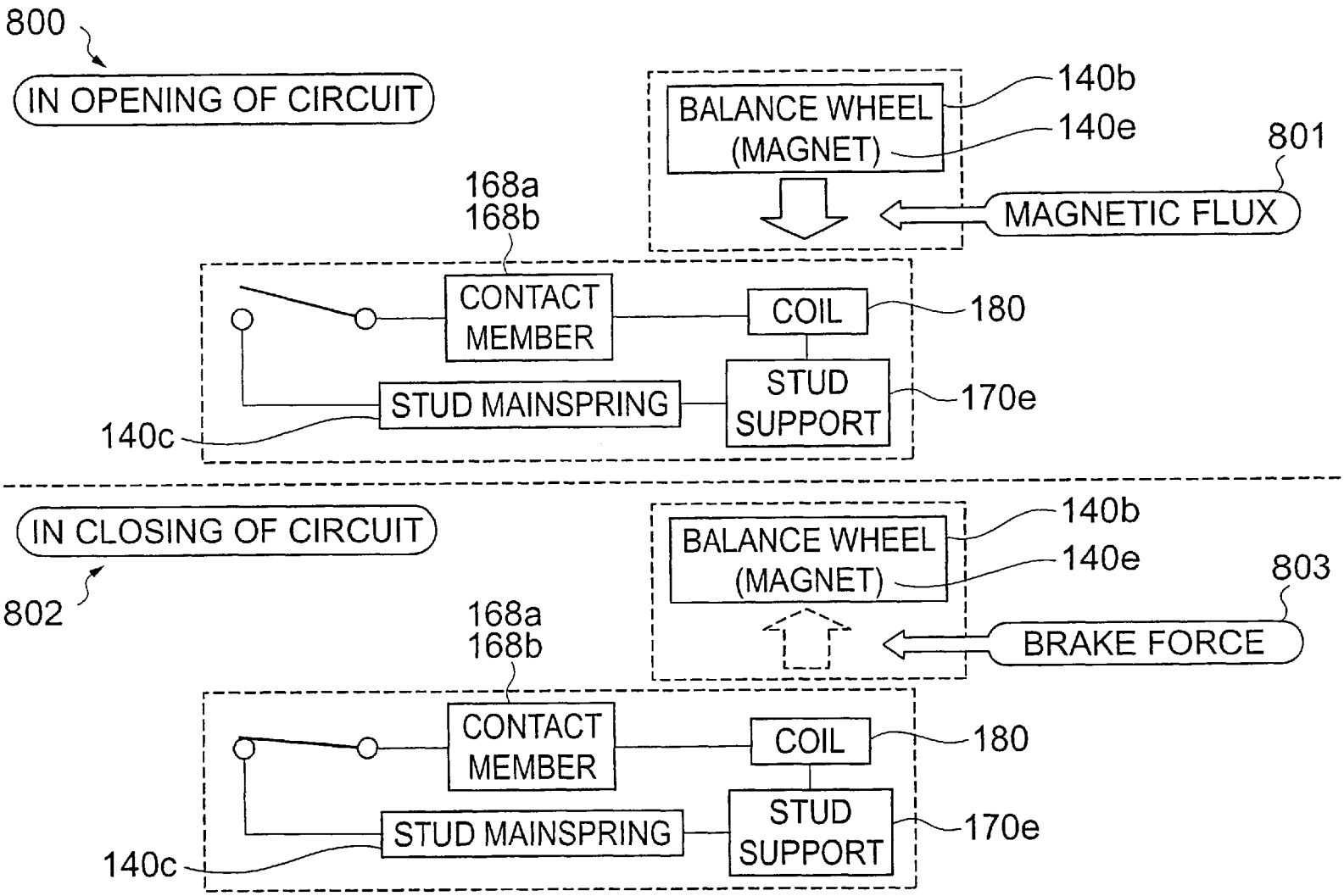
FIG. 11 is a block diagram showing an operation when the circuit is open and an operation when the circuit is close in the mechanical timepiece of the invention.

Referring to FIG. 3, FIG. 4 and FIG. 11, explanation will be made on the operation of the balance with hairspring 140 when the coils 180, 180*a*, 180*b*, 180*c* are not energized, i.e. when the circuit is open.

The stud mainspring 140*c* expands and contracts radially of the stud mainspring 140*c* depending on a rotation angle of stud mainspring 140 rotation. For example, in the state shown in FIG. 3, when the balance with hairspring rotates clockwise, the stud mainspring 140*c* contracts in a direction toward a center of the balance with hairspring 140. On the contrary, when the balance with hairspring 140 rotates counterclockwise, the balance with hairspring 140*c* expands in a direction away from the center of the balance with hairspring 140.

Consequently, in FIG. 4, when the balance with hairspring 140 rotates clockwise, the balance with hairspring 140*c* operates in a manner approaching the second contact member 168*b*. Contrary to this, when the balance with hairspring 140 rotates counterclockwise, the stud mainspring 140*c* operates in a manner approaching the first contact member 168*a*.

Where the rotation angle of the balance with hairspring 140 (swing angle) is less than a constant threshold, e.g. 180 degrees, the stud mainspring 140*c* has a less expansion/contraction amount in the radial direction. Consequently, the stud mainspring 140*c* does not contact the first contact member 168*a*, and does not contact the second contact member 168*b*.

Where the rotation angle of the balance with hairspring 140 (swing angle) is equal to or greater than the constant threshold, e.g. 180 degrees, the stud mainspring 140*c* becomes great in expansion/contraction amount in the radial direction. Consequently, the stud mainspring 140*c* contacts both the first contact member 168*a*, and the second contact member 168*b*.

For example, the stud mainspring 140*c* at a near-outer-end portion 140*ct* positions in a gap of approximately 0.04 millimeter between the first contact member 168*a* and the second contact member 168*b*. Consequently, in a state that the swing angle of the balance with hairspring 140 is in a range exceeding 0 degree but less than 180 degrees, the near-outer-end portion 140*ct* of the stud mainspring 140*c* does not contact the first contact member 168*a* and does not contact the second contact member 168*b*. That is, the stud mainspring 140*c* at its outer end is out of contact with the first contact member 168*a* and out of contact with the second contact member 168*b*. Accordingly, the coils 180, 180*a*, 180*b*, 180*c* are not energized so that the magnetic flux on the balance magnet 140*e* will not have an effect on the coils 180, 180*a*, 180*b*, 180*c*. As a result, the swing angle of the balance with hairspring 140 is free from attenuation due to operation of the balance magnet 140*e* and coils 180, 180*a*, 180*b*, 180*c*.

Next, with reference to FIG. 5, FIG. 6 and FIG. 11, explanation will be made on the operation of the balance with hairspring 140 when the coils 180, 180*a*, 180*b*, 180*c* are energized, i.e. when the circuit is close. That is, FIG. 5 and FIG. 6 show aces that the balance with hairspring 140 has a swing angle 180 degrees or greater.

Figure 6:
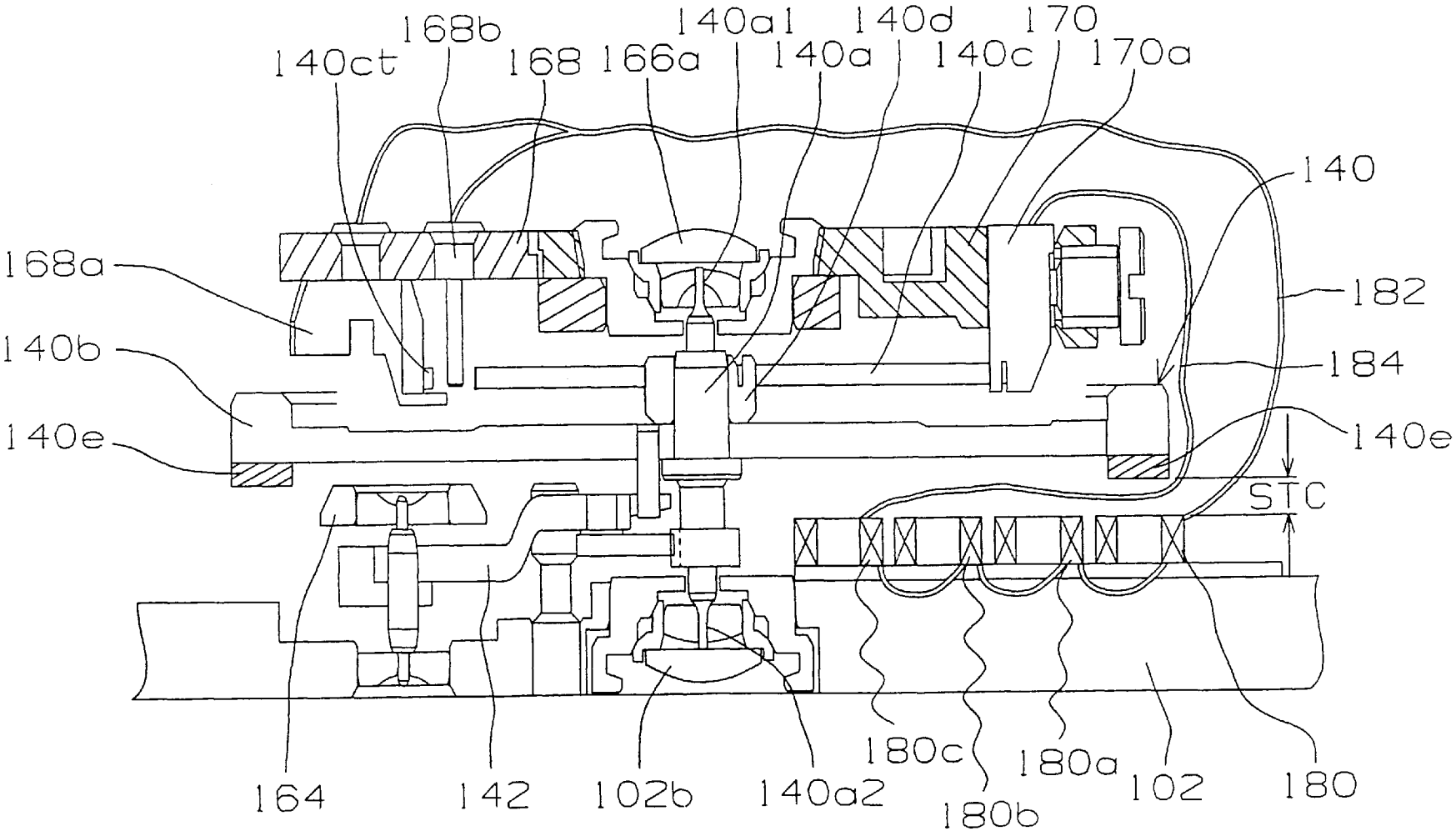

Note that in FIG. 6 the thickness of the stud mainspring 140*c* (thickness in the radial direction of the balance with hairspring) is exaggeratedly shown.

When the swing angle of the balance with hairspring 140 becomes 180 degrees or greater, the stud mainspring at the near-outer-end portion 140*ct* contacts the first contact member 168*a* or the second contact member 168*b*. In such a state, the coils 180, 180*a*, 180*b*, 180*c* are energized and exerts such a force as suppressing rotational motion of the balance with hairspring 140 due to induction current caused by change of magnetic flux on the balance magnet 140*e*. Due to this action, a brake force to the balance with hairspring 140 is applied suppressing the balance with hairspring 140 from rotating thereby decreasing the swing angle of the balance with hairspring 140.

When the swing angle of the balance with hairspring 140 decreases down to a range of exceeding 0 degree but less than 180 degrees, the near-outer-end portion 140*ct* of the stud mainspring 140*c* becomes a state of out of contact with the first contact member 168*a* and out of contact with the second contact member 168*b*. Accordingly, as shown in FIG. 3 and FIG. 4, because the outer end of the stud mainspring 140*c* is out of contact with the first contact member 168*a* and out of contact with the second contact member 168*b*, the coils 180, 180*a*, 180*b*, 180*c* are not energized so that the magnetic flux on the balance magnet 140*e* des not have an effect on the coil 180, 180*a*, 180*b*, 180*c*.

In the mechanical timepiece of the invention thus structured, the swing angle of the balance with hairspring 140 is to be controlled effectively.

The invention, as explained above, is structured having a balance rotation angle control mechanism in a mechanical timepiece structured including a balance with hairspring that an escape/speed control device repeats right and left rotation, an escape wheel and pinion rotating based on rotation of a front train wheel, and a pallet fork controlling rotation of the escape wheel and pinion based on operation of the balance with hairspring. Accordingly, it is possible to improve the accuracy for the mechanical timepiece without reducing a sustaining time of the mechanical timepiece.

That is, in the invention, an eye is placed on the relationship between instantaneous watch error and swing angle. By keeping the swing angle constant, the watch error is suppressed from changing thus providing adjustment to lessen advancement or delay per day of the timepiece.

Contrary to this, in the conventional mechanical timepiece, swing angle changes with lapse of time due to the relationship between sustaining time and swing angle. Furthermore, instantaneous watch error changes with lapse of time due to the relationship between swing angle and instantaneous watch error. Due to this, it has been difficult to increase the sustaining time for a timepiece over which constant accuracy is maintained.

Next, explanation will be made on a result of simulation concerning watch error conducted on the mechanical timepiece of the invention developed to solve the problem with the conventional mechanical timepiece.

Figure 12:
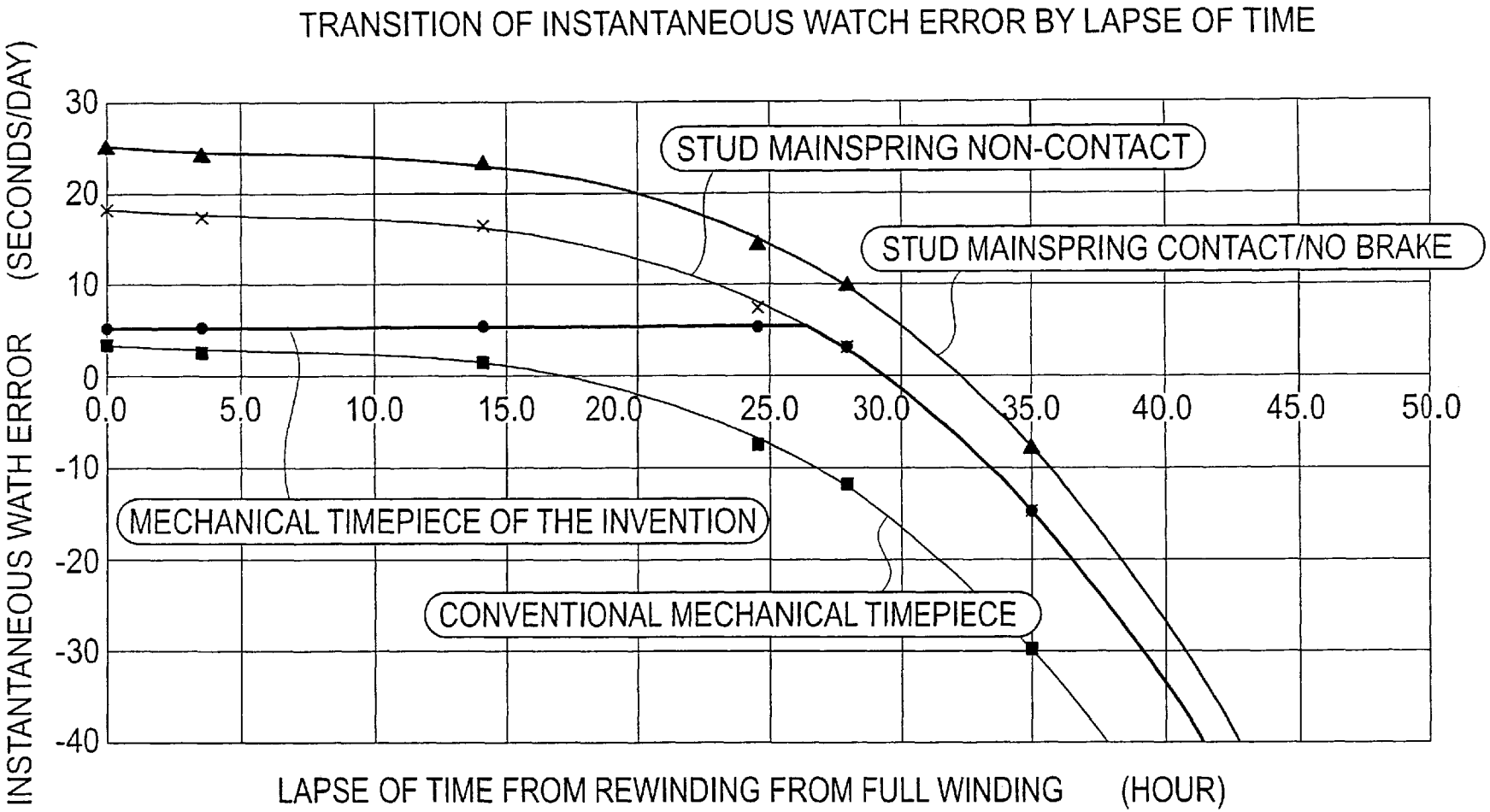
FIG. 12 is a graph schematically showing a relationship between a lapse of time in rewinding from a full winding state and an instantaneous watch error in the mechanical timepiece of the invention and conventional mechanical timepiece.
Figure 13:
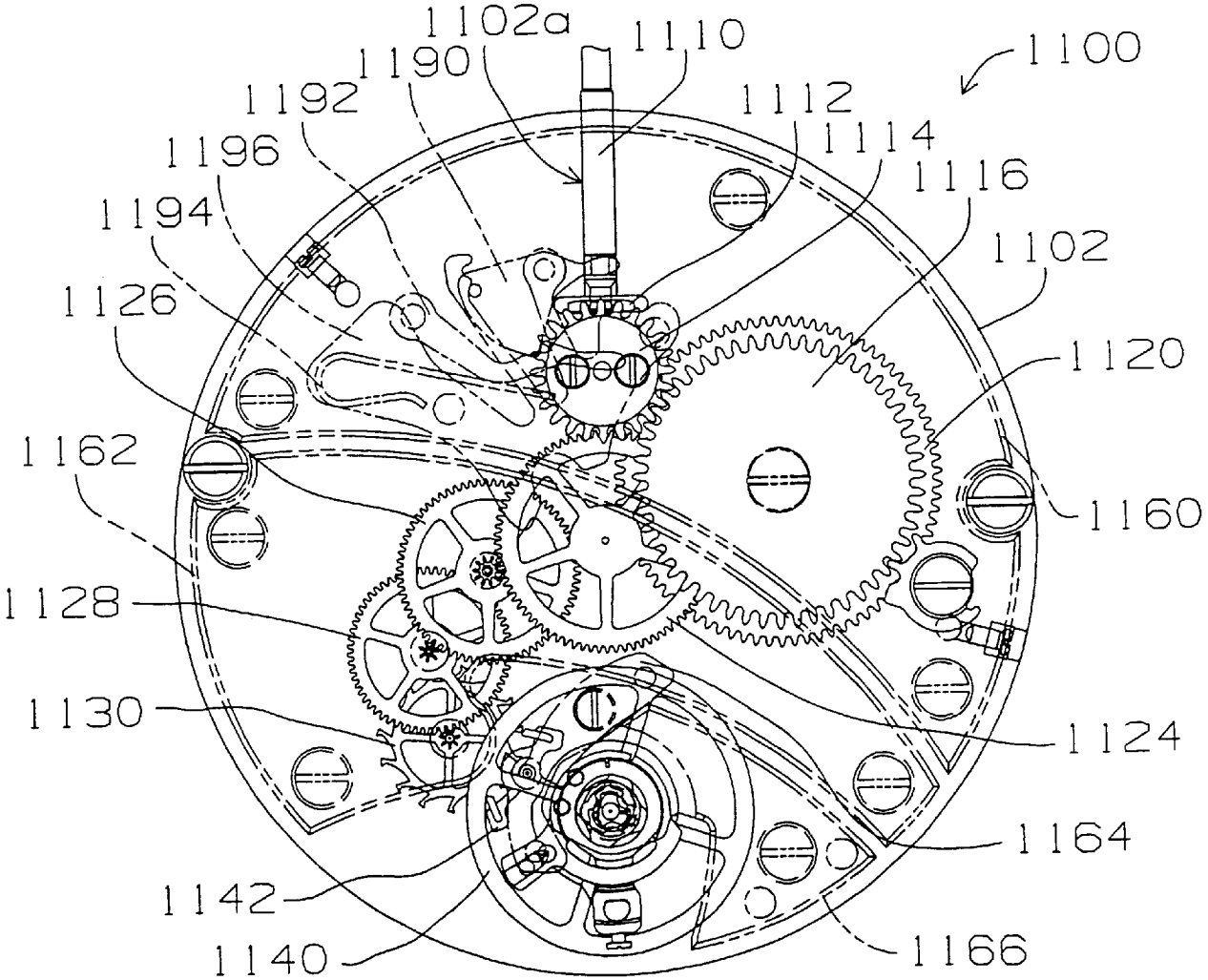
FIG. 13 is a plan view showing a schematic form of a movement front side of a conventional mechanical timepiece (in FIG. 13, parts are partly omitted and bridge members are shown by virtual lines).
Figure 14:
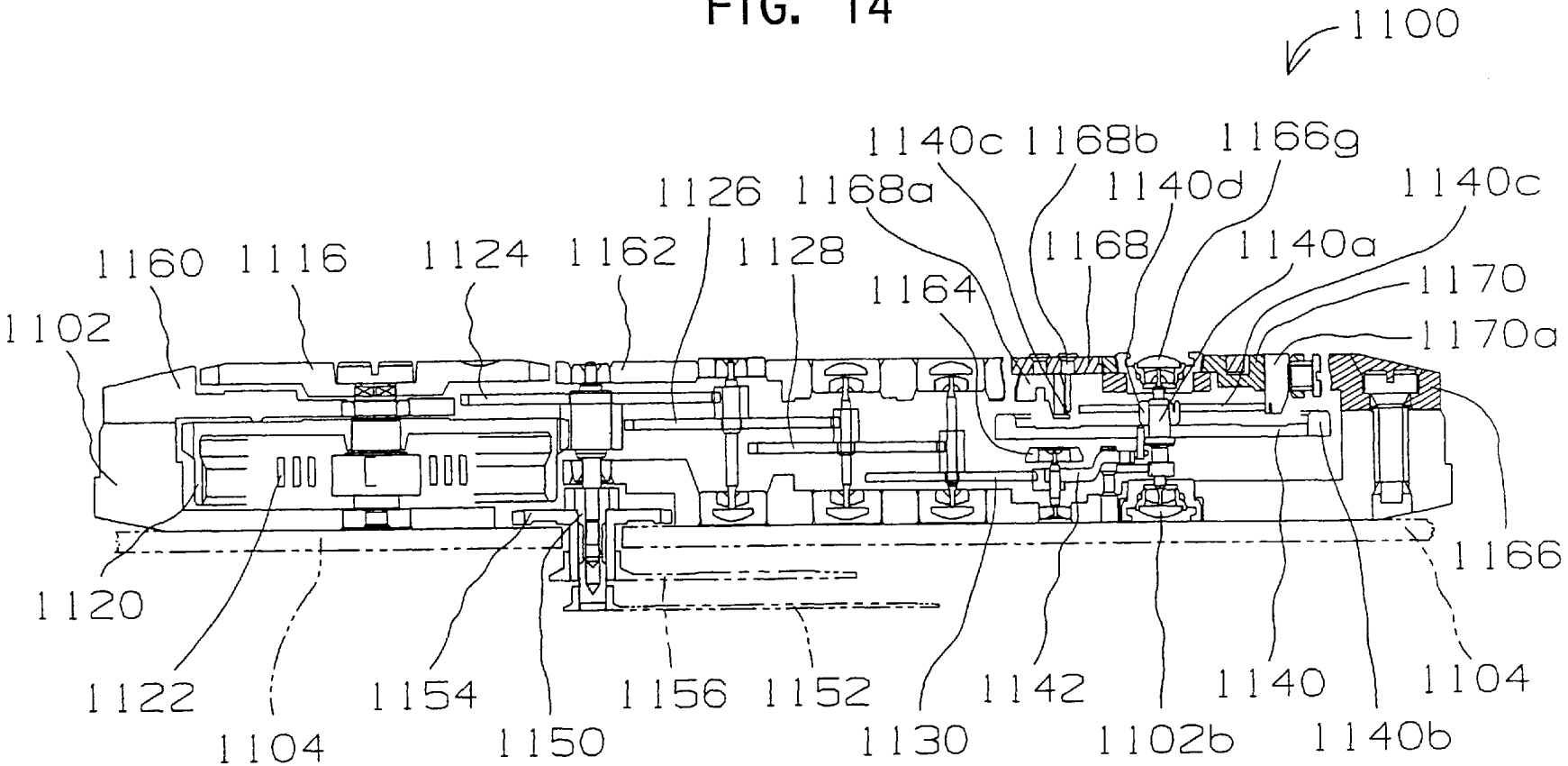
FIG. 14 is a schematic fragmentary sectional view of a movement of a conventional mechanical timepiece (in FIG. 14, parts are partly omitted).

Referring to FIG. 12, in the mechanical timepiece, adjustment is first made to a state the timepiece is advanced in instantaneous watch error as shown by x-marked plotting and thin line. In the mechanical timepiece, where the balance with hairspring 140 rotates a certain angle or greater, if the stud mainspring 140*c* at the outer end contacts the first contact member 168*a* or second contact member 168*b*, the stud mainspring 140*c* is shortened in effective length further advancing the instantaneous watch error.

That is in the mechanical timepiece in a state the stud mainspring 140*c* at the outer end is out of contact with the first contact member 168*a* and out of contact with the second contact member 168*b*, the instantaneous watch error in a full winding state is about 18 seconds per day (about 18 seconds fast per day). When 20 hour elapses from the full winding state, the instantaneous watch error becomes about 13 seconds per day (about 13 seconds fast per day). When 30 hours elapses from the full winding state, the instantaneous watch error becomes about −2 seconds per day (about 2 seconds slow per day).

In the mechanical timepiece of the invention, if assuming the balance rotation-angle control mechanism is not operated, in a state the stud mainspring 140*c* at the outer end is in contact with the first contact member 168*a* or in contact with the second contact member 168*b*, the instantaneous watch error in a full winding state is about 25 seconds per day (about 25 seconds fast per day) as shown in triangle plotting and bold line. When 20 hour elapses from the full winding state, the instantaneous watch error becomes about 20 seconds per day (about 20 seconds fast per day). When 30 hours elapses from the full winding state, the instantaneous watch error becomes about 5 seconds per day (about 5 seconds fast per day).

Contrary to this, in the mechanical timepiece of the invention, when the balance rotation-angle control mechanism is operated, in a state the balance rotation-angle control mechanism is operative, i.e. before lapse of 27 hours from the full winding state of the mainspring the instantaneous watch error can maintain about 5 seconds per day (maintains a state of about 25 seconds fast per day) as shown in black-circle plotting and extreme bold line. When 30 hours elapses from the full winding state, the instantaneous watch error becomes about −2 seconds per day (about 2 seconds slow per day).

The mechanical timepiece having the balance rotation-angle control mechanism of the invention controls swing angle of the balance with hairspring to thereby suppress the timepiece instantaneous watch error from changing. Accordingly, it is possible to increase the lapse of time from the full winding state wherein the instantaneous watch error is about 0 to 5 seconds per day, as compared to the conventional mechanical timepiece shown by square plotting and virtual line in FIG. 12.

That is, the mechanical timepiece of the invention has a sustaining time of about 32 hours for which the instantaneous watch error is within about plus/minus 5 seconds per day. This sustaining time value is about 1.45 times a sustaining time of about 22 hours for the conventional mechanical timepiece having an instantaneous watch error within about plus/minus 5 seconds per day.

Accordingly, a simulation result was obtained that the mechanical timepiece of the invention is well accurate as compared to the conventional mechanical timepiece.

Next, explanations will be made on the positions of the first contact member and second contact member relative to the near-outer-end portion 140 of the stud mainspring as well as a switch adjusting device used for adjusting a gap between the first contact member and the second contact member.

Figure 15:
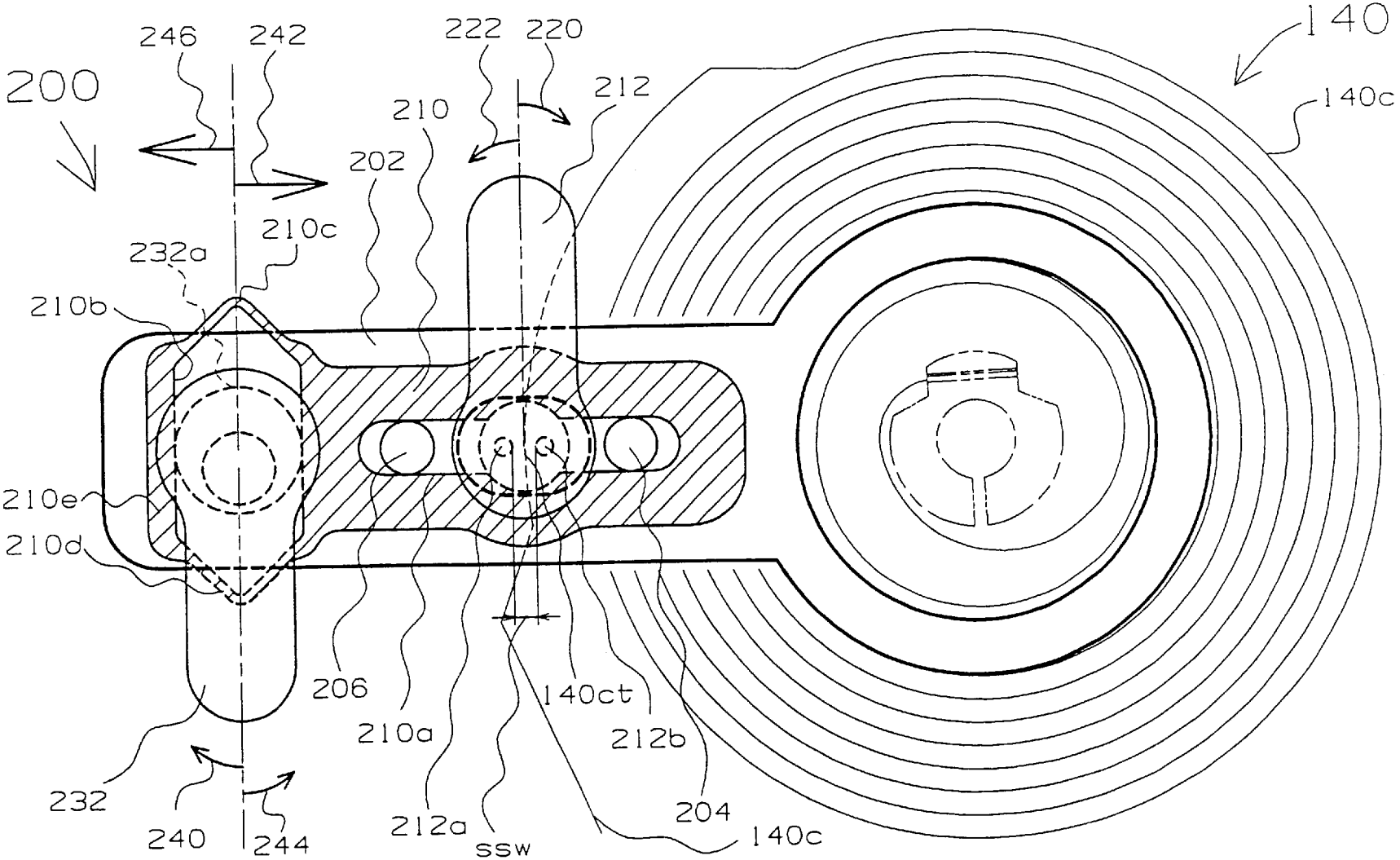
FIG. 15 is a plan view showing a switch adjuster device used in the mechanical timepiece of the invention.
Figure 16:
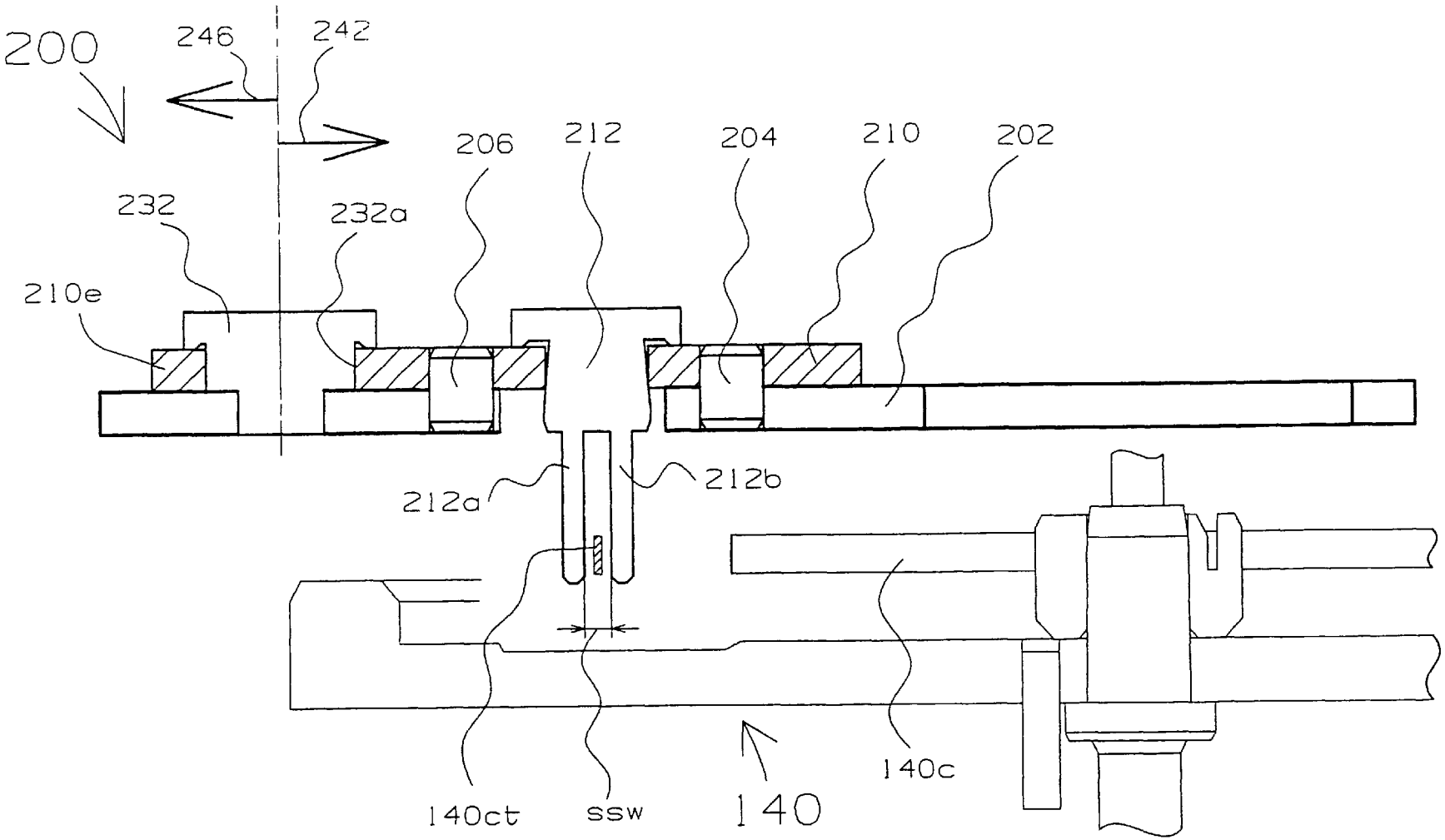
FIG. 16 is a sectional view showing a switch adjuster device used in the mechanical timepiece of the invention.

Referring to FIG. 15 and FIG. 16, a switch adjuster device 200 includes a switch body 202 and a first guide pin 204 and second guide pin 206 provided on the switch body 202. The switch body 202 is formed of metal, such as iron or brass, or plastic. The first guide pin 204 and the second guide pin 206 are formed of metal, such as iron or brass, or plastic. The first guide pin 204 and the second guide pin 206 may be formed as separate members from the switch body 202 and fixed on the switch body 202. Otherwise, the first guide pin 204 and the second guide pin 206 may be formed integral with the switch boy 202. The switch body 202 is mounted on a balance with hairspring (not shown), for rotation about a rotation center of the balance with hairspring.

A switch-insulating member 210 is arranged on the switch body 202 on a side opposite to a side facing the balance with hairspring 140. The switch-insulating member 210 is formed of an insulative material, such as plastic, and of an elastically deformable material. A first elongate hole 210*a*is provided in the switch insulating member 210. In this first elongate hole 210*a*, the first guide pin 204 and the second guide pin 206 are received. The switch-insulating member 210 is slidably arranged relative to the switch member 202. The switch-insulating member 210 has a slide direction that is coincident with a straight line passing a center of the second guide pin 206 and center of the balance with hairspring 140.

A switch spacing-adjusting lever 212 is rotatably provided in the switch-insulating member 210 by a slip mechanism. The switch spacing adjusting lever 212 at its cylindrical-portion outer periphery is assembled in a circular portion provided in part of the first elongate hole 210*a*of the switch insulating member 210. Because the circular portion partly provided in the first elongate hole 210*a*of the switch insulating member 210 is structured to be fit in the cylindrical portion of the switch spacing adjusting lever 212 through elastic force, the switch spacing adjusting lever 212 can fix rotation in an arbitrary position.

A first contact 212*a* and a second contact 212*b* are provided on the switch spacing-adjusting lever 212 on a side facing the balance with hairspring 140. The first contact 212*a* and the second contact 212*b* are provided in positions eccentric relative to a rotation enter of the switch spacing-adjusting lever 212. The first contact 212*a* and the second contact 212*b* are formed in axis-symmetry to a straight line including the rotation center of the switch spacing-adjusting lever 212.

The near-outer-end portion 140*ct* of the stud mainspring 140*c* is positioned in a gap SSW between the first contact 212*a* and the second contact 212*b*. For example, the gap is approximately 0.06 millimeter.

By rotating the switch spacing adjusting lever 212 in a direction of an arrow 220 (clockwise in FIG. 15) or a direction of an arrow 222 (counterclockwise in FIG. 15), the first contact 212*a* and second contact 212*b* can be rotated. This allows for changing the distance between the first contact 212*a* and the second contact 212*b* in a direction of a straight line passing the center of the balance with hairspring 140.

Furthermore, a switch position-adjusting lever 232 is provided rotatable by a slip mechanism relative to the switch body 202, and to be fixed in an arbitrary position. The switch position-adjusting lever 232 has an eccentric portion 232*a* to be fitted in a second elongate hole 210*b* of the switch-insulating member 210. The second elongate hole 210*b* has a lengthwise center axis directed perpendicular to a direction of a straight line passing a center of the second guide pin 206 and center of the balance with hairspring 140. That is, the direction of the lengthwise center axis of the second elongate hole 210*b* is perpendicular to a lengthwise center axis of the first elongate hole 210*a*. Elastically deformable portions 210*c* and 210*d* of the switch insulating member 210 forming elastically deformable widths are provided at lengthwise opposite ends of the second elongate hole 210*b*. A rigid portion 210*e* of the switch insulating member 210 forming an elastically non-deformable width is provided on an outer side of the second elongate hole 210*b* (on a side remote from the outer end of the stud mainspring 140*c*). Consequently, the width of the rigid portion 210*e* is formed greater than the width of the elastically deformable portion 210*c* and 210*d*. The rigid portion 210*e* at its inner side is arranged in contact with the eccentric portion 232*a* of the switch position-adjusting lever 232.

By rotating the switch position-adjusting lever 232 in a direction of an arrow 240 (clockwise in FIG. 15), the eccentric portion 232*a* can be rotated. Due to this, the switch insulating member 210 is allowed to move in a direction toward the center of the balance with hairspring 140 (in a direction of an arrow 242 in FIG. 15 and FIG. 16) in a direction of a straight line passing the center of the balance with hairspring 140. As a result, the first contact 212*a* moves toward the near-outer-end portion 140*ct* of the stud mainspring 140*c* while the second contact 212*b* moves away from the near-outer-end portion 140*ct* of the stud mainspring 140*c*.

By rotating the switch position-adjusting lever 232 in a direction of an arrow 244 (counterclockwise in FIG. 15), the eccentric portion 232*a* can be rotated. Due to this, the switch-insulating member 210 is allowed to move in a direction away from the center of the balance with hairspring 140 (in a direction of an arrow 246 in FIG. 15 and FIG. 16). As a result, the first contact 212*a* moves away from the near-outer-end portion 140*ct* of the stud mainspring 140*c* while the second contact 212*b* moves toward the near-outer-end portion 140*ct* of the stud mainspring 140*c*.

Figure 17:
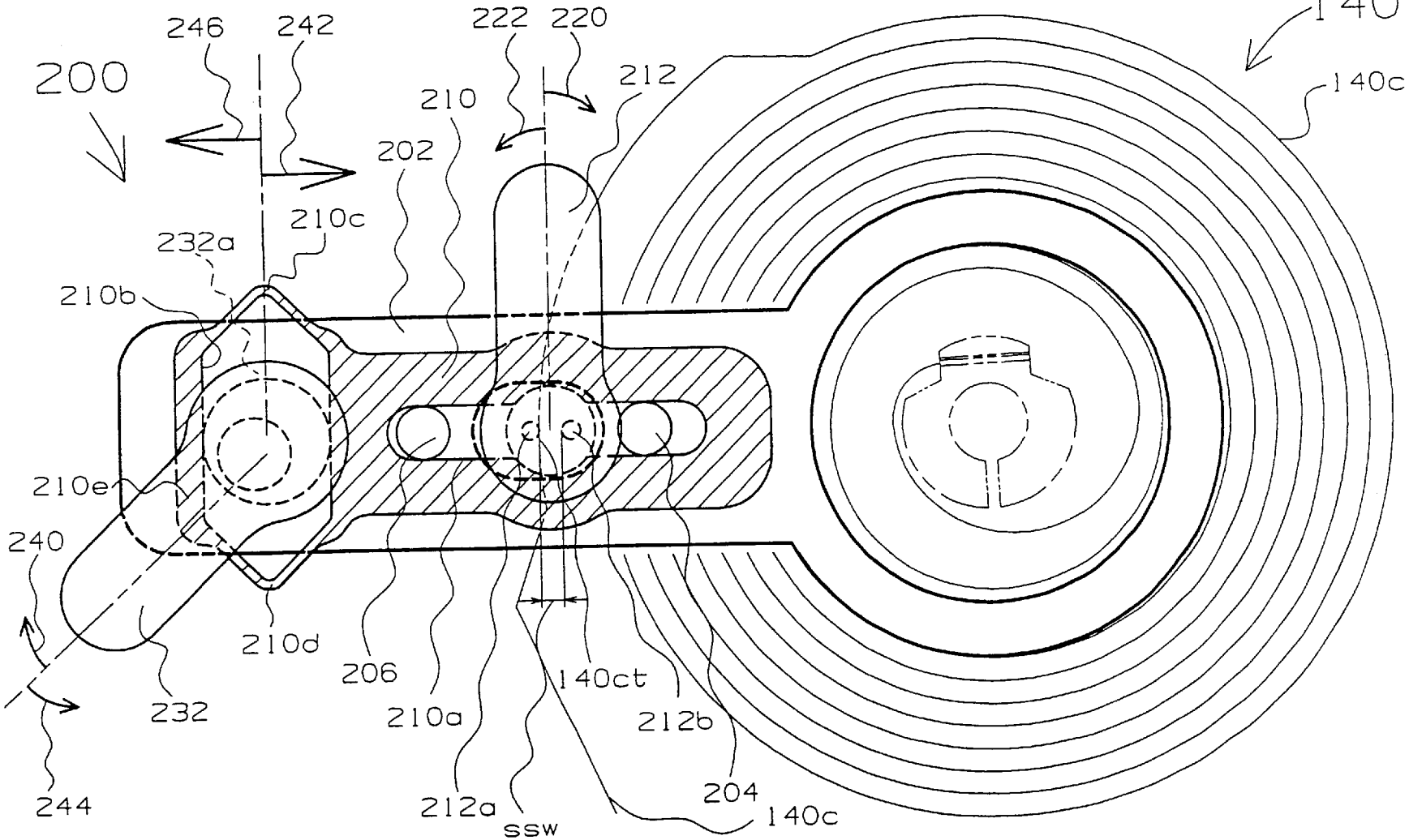
FIG. 17 is a plan view showing a state a switch position adjusting lever is rotated in the switch adjuster device used in the mechanical timepiece of the invention.
Figure 18:
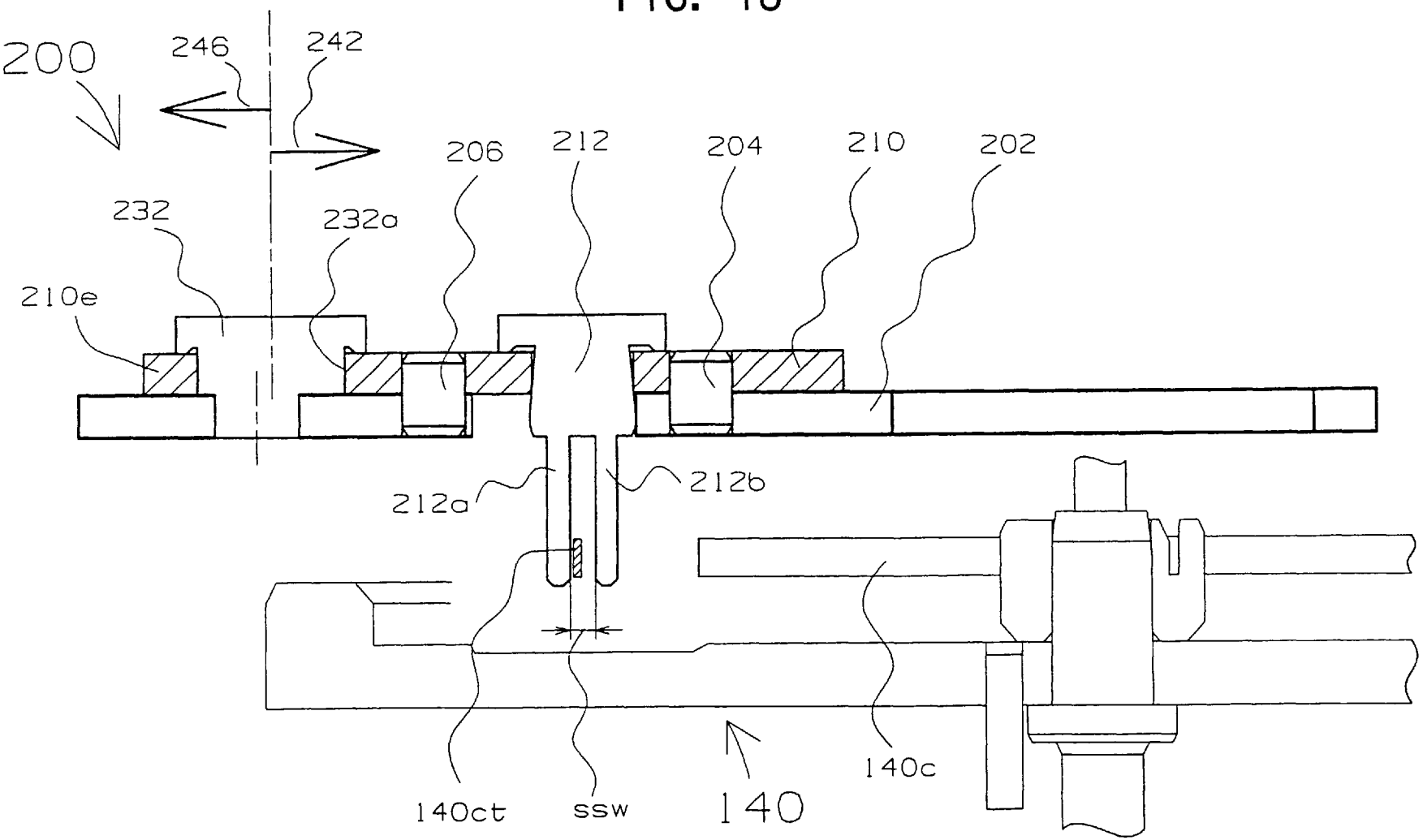
FIG. 18 is a sectional view showing a state a switch position-adjusting lever is rotated in the switch adjuster device used in the mechanical timepiece of the invention.

FIG. 17 and FIG. 18 illustrates a state that in FIG. 15 and FIG. 16 the switch position adjusting lever 232 is rotated in a direction of the arrow 240 (clockwise in FIG. 15). By rotation of the switch position-adjusting lever 232, the eccentric portion 232*a* is rotated. The switch-insulating member 210 moves in a direction toward the center of the balance with hairspring 140. The first contact 212*a* moves toward the near-outer-end portion 140*ct* of the stud mainspring 140*c*, and the second contact 212*b* moves away from the near-outer-end portion 140*ct* of the stud mainspring 140*c*. In such operation of rotating the switch position-adjusting lever 232, there is no change in the gap SSW between the first contact 212*a* and the second contact 212*b*.

Figure 19:
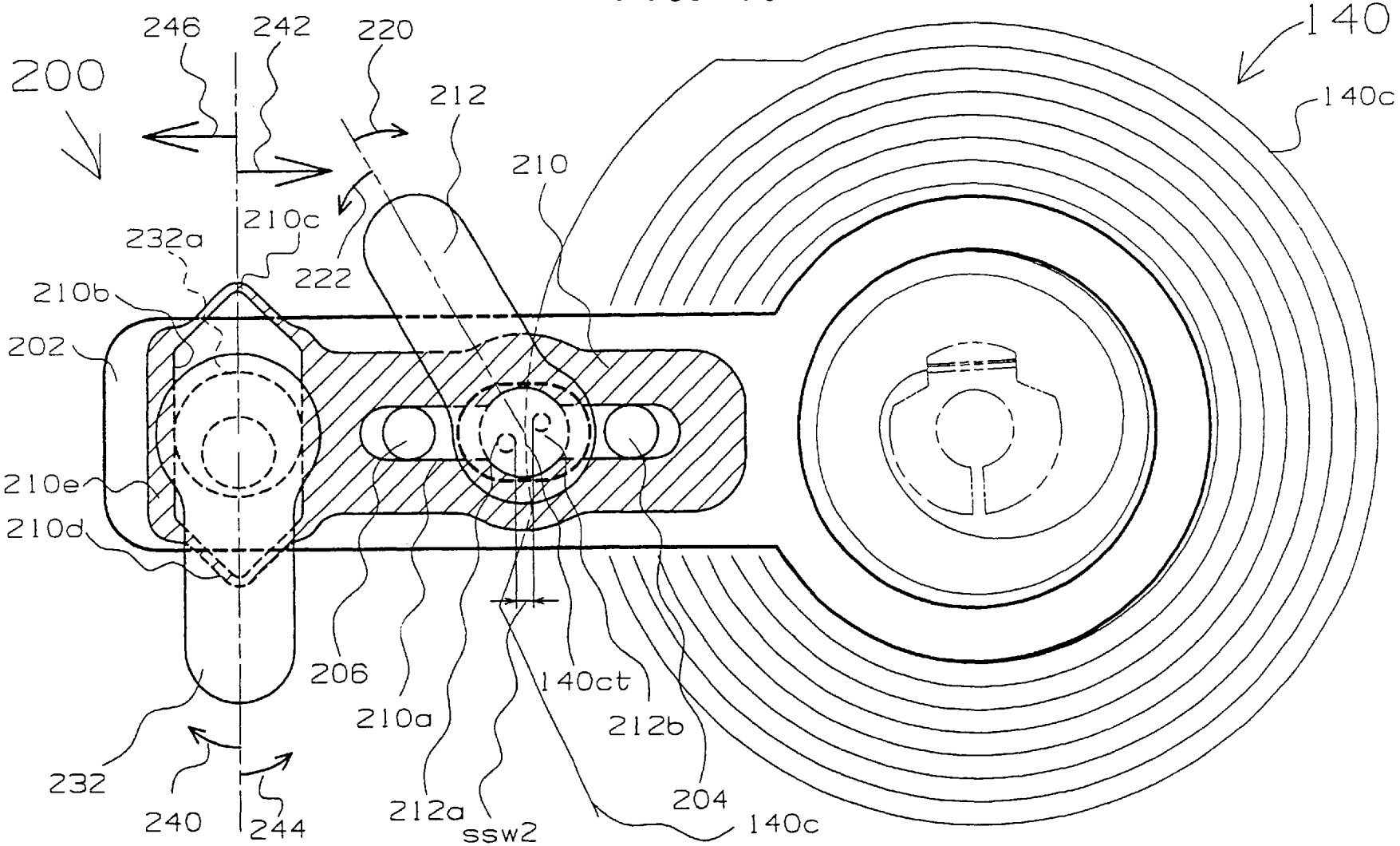
FIG. 19 is a plan view showing a state a switch space-adjusting lever is rotated in the switch adjuster device used in the mechanical timepiece of the invention.
Figure 20:
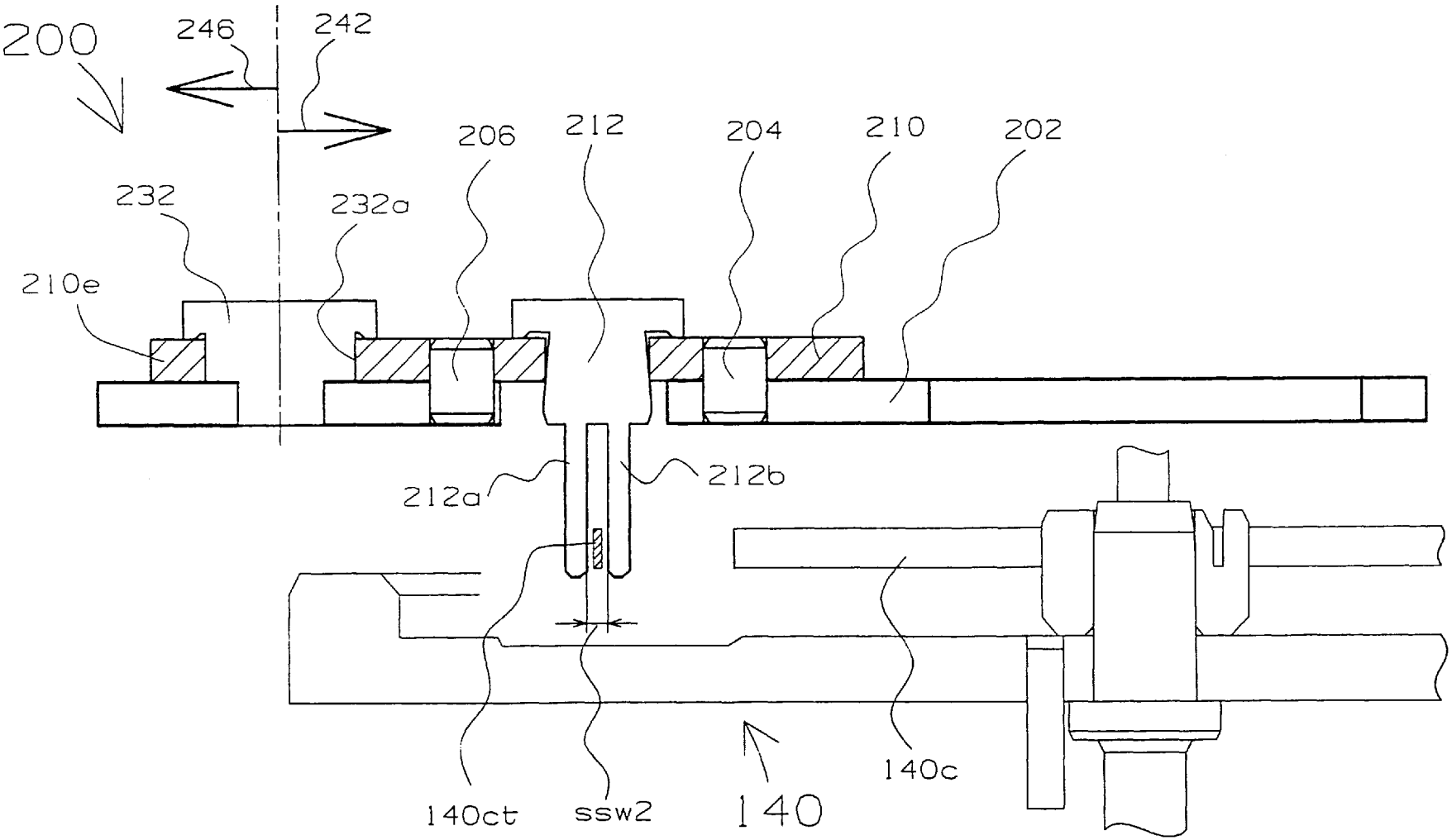
FIG. 20 is a sectional view showing a state a switch space-adjusting lever is rotated in the switch adjuster device used in the mechanical timepiece of the invention.

FIG. 19 and FIG. 20 illustrates a state that in FIG. 15 and FIG. 16 the switch spacing adjusting lever 212 is rotated in a direction of the arrow 222 (counterclockwise in FIG. 15). By rotation of the switch spacing adjusting lever 212, the first contact 212*a* and the second contact 212*b* are rotated to decrease a distance in a direction of a straight line passing the center of the balance with hairspring 140 between the first contact 212*a* and the second contact 212*b*. Consequently, the distance in the direction of the straight line passing the center of the balance with hairspring 140 between the first contact 212*a* and the second contact 212*b* changes to SSW2 smaller than SSW.

As explained above, in the mechanical timepiece of the invention, the use of the switch adjuster device 200 makes it possible to adjust the positions of the first contact 212*a* and second contact 212*b* relative to the near-outer-end portion 140*ct* of the stud mainspring. By adjusting the gap between the first contact 212*a* and the second contact 212*b*, it is possible to adjust a distance between the near-outer-end portion 140*ct* and the first contact 212*a* as well as a distance between the near-outer-end portion 140*ct* and the second contact 212*b*.

By applying the two adjuster mechanism as explained above to a switch adjuster device, it is easily adjust a swing angle that the switch turns ON/OFF.

Accordingly, in the mechanical timepiece of the invention shown in FIG. 1 and FIG. 2, where using a switch adjuster device 200, a first contact 212*a* may be arranged in place of the first contact member 168*a* and a second contact 212*b* in place of the second contact member 168*b*.

The switch adjuster device for a mechanical timepiece of the invention is applicable to a conventional regulator device for a mechanical timepiece. In such a case, the first contact 212*a* corresponds to a regulator and the second contact 212*b* to a stud rod.

With such structure, it is possible to adjust a regulator and stud rod for a mechanical timepiece with accuracy and efficiency.

Industrial Applicability

The mechanical timepiece of the present invention has a simple structure and is suited for realizing an extreme accurate mechanical timepiece.

Furthermore, the mechanical timepiece of the invention has a switch adjuster device which enables an accurate mechanical timepiece with efficiency greater than the conventional mechanical timepiece to be manufactured.

FIG. 8

MAINSPRING TORQUE CURVE

MAINSPRING TORQUE

LAPSE OF TIME IN WINDING FROM FULL WINDING HOUR

FIG. 9

MAINSPRING TORQUE—SWING ANGLE

MAINSPRING TORQUE

SWING ANGLE DEGREE

FIG. 10

TRANSITION OF INSTANTANEOUS WATCH ERROR DUE TO SWING ANGLE

INSTANTANEOUS WATCH ERROR SECOND/DAY

SWING ANGLE DEGREE

FIG. 11

IN OPENING OF CIRCUIT
168*a*, 168*b* CONTACT MEMBER
140*c* STUD MAINSPRING
140*b* BALANCE WHEEL 140*e* (MAGNET)

MAGNETIC FLUX
180 COIL
170*e* STUD SUPPORT

IN CLOSING OF CIRCUIT
168*a*, 168*b* CONTACT MEMBER
140*c* STUD MAINSPRING
140*b* BALANCE WHEEL 140*e* (MAGNET)

BRAKE FORCE
180 COIL
STUD SUPPORT

FIG. 12

TRANSITION OF INSTANTANEOUS WATCH ERROR BY LAPSE OF TIME

INSTANTANEOUS WATCH ERROR SECONDS/DAY

STUD MAINSPRING NON-CONTACT

STUD MAINSPRING CONTACT/NO BRAKE

MECHANICAL TIMEPIECE OF THE INVENTION

CONVENTIONAL MECHANICAL TIMEPIECE

LAPSE OF TIME FROM REWINDING FROM FULL WINDING HOUR

What is claimed is:

1. A mechanical timepiece comprising:

a power source comprised of a mainspring for undergoing rewinding movement to generate a rational force;

a front train wheel for undergoing rotation in accordance with a rotational force generated during rewinding movement of the mainspring;

an escapement/speed-control device for controlling rotation of the front train wheel, the escapement/speed-control device having a balance with a hairspring for undergoing alternatively repeating rotational movement in left and right directions;

an escape wheel and pinion for undergoing rotation in accordance with rotation of the front train wheel;

a pallet fork for controlling rotation of the escape wheel and pinion in accordance with rotational movement of the balance;

a switch mechanism for outputting an ON signal when a rotation angle of the balance reaches a predetermined threshold angle or greater, and for outputting an OFF signal when the rotation angle of the balance does not exceed the predetermined threshold angle; and a rotation angle control mechanism for suppressing rotation of the balance when the switch mechanism outputs an ON signal.

2. A mechanical timepiece as claimed in claim 1;

further comprising a switch lever and a stud mainspring disposed on the balance for contacting the switch lever;

wherein the switch mechanism outputs an ON signal when the stud mainspring contacts the switch lever.

3. A mechanical timepiece as claimed in claim 1;

wherein the rotation angle control mechanism has a balance magnet disposed on the balance and a coil arranged to apply a magnetic force to the balance magnet to suppress rotation of the balance when the switch mechanism outputs an ON signal, and to not apply a magnetic force to the balance magnet when the switch mechanism outputs an OFF signal.

4. A mechanical timepiece as claimed in claim 1;

wherein the switch mechanism has a first contact member and a second contact member; and further comprising an adjuster device for varying a spacing between the first contact member and the second contact member.

5. A mechanical timepiece as claimed in claim 1;

wherein the switch mechanism has a first contact member and a second contact member; and further comprising an adjuster device for simultaneously moving the first contact member and the second contact member relative to a rotation center of the balance.

6. A mechanical timepiece as claimed in claim 4 or claim 5;

wherein the adjuster device has a switch body for undergoing rotation about a rotation center of the balance, a switch insulating member for undergoing sliding movement relative to the switch body, and a switch spacing adjusting lever having a first contact portion and a second contact portion.

7. A mechanical timepiece as claimed in claim 4;

wherein the adjuster device has a switch body for undergoing rotation about a rotation center of the balance, a switch insulating member for undergoing sliding movement relative to the switch body, and a switch position adjusting lever having an eccentric portion for undergoing rotation relative to the switch body and for engaging an elongate hole of the switch insulating member.

8. An adjuster device for a mechanical timepiece, the adjuster device comprising:

a switch body for undergoing rotation about a rotation center of a balance having a hairspring;

a switch insulating member for undergoing sliding movement relative to the switch body; and a switch spacing-adjusting lever having a first contact portion and a second contact portion.

9. An adjuster device for a mechanical timepiece, the adjuster device comprising:

a switch body for undergoing rotation about a rotation center of a balance having a hairspring;

a switch insulating member for undergoing sliding movement relative to the switch body; and a switch position adjusting lever for undergoing rotation relative to the switch member and having an eccentric portion for insertion into an elongate hole of the switch insulating member.

* * * * *